US005241129A

United States Patent [19]

Muto et al.

[11] Patent Number: 5,241,129

[45] Date of Patent: Aug. 31, 1993

[54] ELECTRONIC MUSICAL INSTRUMENT HAVING PHYSICAL MODEL TONE GENERATOR

[75] Inventors: Takaaki Muto; Chifumi Takeuchi, both of Hamamatsu, Japan

[73] Assignee: Yamaha Corporation, Hamamatsu, Japan

[21] Appl. No.: 833,934

[22] Filed: Feb. 11, 1992

[30] Foreign Application Priority Data

Feb. 15, 1991 [JP] Japan ..... 3-22336

[51] Int. Cl.[5] ..... G10H 1/057; G10H 1/08; G10H 1/12

[52] U.S. Cl. ..... 84/625; 84/627; 84/660; 84/661; 84/663; 84/DIG. 9; 84/DIG. 10

[58] Field of Search ..... 84/603, 607, 608, 622, 84/624, 625, 627, 630, 631, 659-661, 663, 664, 694-700, 702, 703, 707, 708, DIG. 4, DIG. 9, DIG. 10, DIG. 26; 381/63-65

[56] References Cited

U.S. PATENT DOCUMENTS

| | | | |
|---|---|---|---|
| 4,691,608 | 9/1987 | Sasaki et al. | 84/603 |
| 4,748,888 | 6/1988 | Oya | 84/624 X |
| 4,984,276 | 1/1991 | Smith | 84/630 |

*Primary Examiner*—Stanley J. Witkowski

*Attorney, Agent, or Firm*—Graham & James

[57] ABSTRACT

An object of the present invention is to provide an electronic musical instrument which can generate a plurality of tones in spite of the inexpensive and simple structure thereof and can correct the quantity of phase delay of a closed loop in a physical model tone generator without use of any special processor such as a high-speed CPU or a dedicated numerical operation processor, not only to thereby attain performance effects of echo, chorus and the like but to simulate a performance style of repeating the operation of one string or key in the condition in which a tone corresponding to the string or key remains, without production of noise even when parameters for constituent elements of the physical model tone generator are respectively changed widely. The electronic musical instrument includes a driving waveform for storing a plurality of driving waveform data corresponding to performance information in advance, and a closed loop constituted by a shift register and a low-pass filter. The plurality of driving waveform data are supplied into the closed loop and repeatedly circulated while applying at least a delay process and a decay process onto the plurality of driving waveform data by way of time division corresponding to the performance information. As a result, a plurality of signals circulating in the closed loop are generated as a plurality of tone signals.

10 Claims, 14 Drawing Sheets

ELECTRONIC MUSICAL INSTRUMENT HAVING PHYSICAL MODEL TONE GENERATOR

BACKGROUND OF THE INVENTION

1. Field of the Invention

The present invention relates to an electronic musical instrument for generating musical tones changing like a natural musical instrument having a decay tone property such as a plucked string instrument.

2. Description of the Related Art

In the recent years, a wide variety of musical tones have been generated from electronic musical instruments with the improvement of techniques. Various types of physical model (delay feedback algorithm) tone generators for synthesizing tones of natural musical instruments by operating models obtained through simulating the principle of tone generation of the actual natural musical instruments have been proposed as one of tone generators for use in the electronic musical instruments.

Among the physical model tone generators, a tone generator having a structure in which a nonlinear element simulating the elastic characteristic of a string and a delay circuit having a delay time equivalent to the vibration period of the string are connected in a closed loop is known as a physical model tone generator for simulating a string instrument. A signal circulating in the loop is picked up out of the loop as a tone signal of a string instrument, while the loop circuit can be deemed to life in a resonant state. This type of technique has been disclosed in Japanese Patent Unexamined Publication No. Sho-63-40199 (U.S. Pat. No. 4,984,276), Japanese Patent Postexamin. Publication No. Sho-58-58679 (U.S. Pat. No. 4,130,043), and Japanese Patent Postexamin. Publication No. Sho-58-48019.

To generate a plurality of musical tones, a plurality of tone generator channels are used and each of the tone generators has a loop circuit. For example, a rubbed string instrument such as a violin generally requires four channels and a plucked string instrument such as a guitar generally requires six channels, for corresponding with strings of the natural instruments. A driving signal generator for giving a driving signal to the loop circuit is provided in each of the channels.

For example, a driving waveform ROM is provided in each of the physical model tone generators. Accordingly, the number of driving waveform ROMs must increase by the number of tones to be generated.

Further, parameters of an LPF 12, an APF 13 and the like to give a variation to the tone signal are calculated by arithmetic operations. On the other hand, rapid response is required at the time of tone generation (or in the period of tone generation) to prevent the lagging of tone generation. Therefore, a special processor such as a high-speed CPU or a dedicated numerical operation processor is required in order to carry out the arithmetic operations at the time of tone generation or in the period of tone generation.

Further, if the aforementioned conventional electronic musical instrument, noise may be produced when parameters (such as a feedback coefficient and a filter coefficient in the closed loop) for constituent elements in each of the physical model tone generators are changed widely, because a discontinuous portion is formed in the output signal at the time of the changing of the parameters.

Further, the output signals from the respective physical model tone generators are mixed simply. Accordingly, wide performance effects of echo, chorus, etc., cannot be achieved.

Further, when a released key in a keyboard in a control manipulator is newly depressed in the condition in which the tone of the channel (physical model tone generator) assigned for the released key decays but remains, the CPU carries out a forcing damp process and then gives a tone generation starting instruction to the corresponding physical model tone generator again in the timing of the channel. Accordingly, the performance style of repeatedly manipulating a string or key in the condition in which the tone of the string or key remains as if a string in a plucked string instrument such as a guitar were repeatedly plucked cannot be simulated.

SUMMARY OF THE INVENTION

An object of the present invention is to provide an electronic musical instrument in which: a plurality of tones can be generated by an inexpensive and simple structure; the phase delay quantity of the closed loop in each of physical model tone generators can be corrected without use of a special processor such as a high-speed CPU or a dedicated numeral operation processor; there is no generation of noise even when parameters for respective constituent elements in each of the physical model tone generators are changed widely; the performance effects of echo, chorus, etc., can be provided; and the performance style of repeatedly manipulating a string or key in a plucked string instrument such as a guitar in the condition in which the tone of the string or key remains can be simulated without deformation of the waveform of the resulting tone signal.

According to an aspect of the present invention, there is provided an electronic musical instrument comprising: a driving signal generator means for generating a plurality of driving signals corresponding to performance information; and a loop means for repeatedly circulating the plurality of driving signals by applying at least a delay process and a decay process to the plurality of driving signals by way of time division correspondingly to the performance information, to thereby generate a plurality of signals circulating in the loop as a plurality of tone signals, with the loop means put into a resonant state.

In the resonant state, the loop means applies processes such as a delay process and a decay process corresponding to the performance information onto the plurality of driving signals supplied correspondingly to the performance information to thereby repeatedly circulate the plurality of driving signals. Hereby, the plurality of signals circulating in the loop are outputted as a plurality of tone signals.

According to another aspect of the invention, there is provided an electronic musical instrument comprising: a driving signal generator means for generating a driving signal corresponding to performance information; and a loop means for repeatedly circulating the driving signal by applying at least a delay process and a decay process to the driving signal correspondingly to the performance information, to thereby generate a signal circulating in the loop as a tone signal, with the loop means put into a resonant state; the electronic musical instrument further comprising a memory means for storing parameters used in the respective processes applied in the loop means correspondingly to the performance information, by which the loop means applies the respective processes to the driving signals by using the parameters stored in the memory means correspondingly to the performance information.

In the resonant state, the loop means applies at least a delay process and a decay process corresponding to the performance information onto the driving signal supplied correspondingly to the performance information to thereby repeatedly circulate the driving signal. Hereby, the signal circulating in the loop is outputted as a tone signal.

Preferably, the electronic musical instrument further comprises coefficient interpolation circuits for interpolating values of respective coefficients used in the respective processes applied in the loop means to target values corresponding to the performance information at a predetermined speed.

Hereby, the signal circulating in the loop is outputted as a tone signal without any noise.

Preferably, the electronic musical instrument further comprises a mixer means for mixing signals outputted from a plurality of points in the loop in the loop means, to thereby generate an output signal from the mixer means as a tone signal with the loop means put into a resonant state.

According to another aspect of the invention, there is provided an electronic musical instrument comprising: a driving signal generator means for generating a plurality of driving signals corresponding to performance information; and a plurality of loop means for repeatedly circulating the plurality of driving signals by applying at least a delay process and a decay process onto the plurality of driving signals correspondingly to the performance information while changing the sampling frequency synchronized with the tone within an octave and changing the delay time between octaves, to thereby generate a plurality of signals circulating in the respective loops as a plurality of tone signals, with the plurality of loop means put into resonant states respectively.

Hereby, the plurality of signals circulating the respective loops are outputted as a plurality of tone signals.

According to another aspect of the invention, there is provided an electronic musical instrument comprising: a memory means for storing pulse code modulated waveform data; a tone generator means for generating a tone signal through reading the waveform data from the memory means correspondingly to performance information; an envelope generator for generating an envelope signal for controlling the amplitude of the tone signal to thereby control the volume and tone color of the tone signal; a multiplier means for multiplying the waveform signal read from the memory means by the envelope signal; a loop means for circulating an output signal from the multiplier means by applying processes such as a delay process and a decay process to the output signal correspondingly to the performance information; and a mixer means for mixing an output signal from the tone generator means with the output signal from the loop means.

The tone generator means reads waveform data from the memory means to generate a tone signal correspondingly to the performance information. On the other hand, a part of the waveform data read from the memory means is multiplied by the envelope signal in the multiplier means, so that the multiplied signal is supplied into the loop means. The loop means applies at least a delay process and a decay process corresponding to the performance information onto the output signal from the multiplier means to thereby repeatedly circulate the signal. Then, the mixer means mixes the output signal from the tone generator means and the output signal from the loop means with each other and outputs the resulting mixed signal.

According to an another aspect of the invention, there is provided an electronic musical instrument comprising: a driving signal generator means for generating a plurality of driving signals corresponding to plural pieces of performance information; and a plurality of loop means for repeatedly circulating the plurality of driving signals by applying at least a delay process and a decay process onto the plurality of driving signals correspondingly to the plural pieces of performance information, to thereby generate a plurality of signals circulating in the respective loops as a plurality of tone signals, with the plurality of loop means put into resonant states respectively, while assigning the plural pieces of performance information to the plurality of loop means, in which when one and the same performance information is newly supplied in the condition where a decayed signal remains in an already assigned loop means, the performance information is assigned to the loop means and at the same time the level of the signal circulating in the loop is detected and subtracted from the level of a driving signal outputted from the driving signal generator means correspondingly to the performance information to supply the resulting level to the loop means.

When one and the same performance information is supplied newly in the condition where a signal decays but remains in an already assigned loop means, the performance information is assigned to the loop means and, at the same time, the level of the signal circulating in the loop is detected. The level obtained by subtracting the detected level from the level of the driving signal outputted from the driving signal generator means correspondingly to the performance information is supplied to the loop means. Accordingly, in the resonant state, the corresponding loop means applies at least a delay process and a decay process corresponding to the performance information onto the driving signal having the subtracted level, to thereby repeatedly circulate the driving signal. Hereby, the signal circulating in the loop is outputted as a tone signal.

According to another aspect of the invention, there is provided an electronic musical instrument comprising: a driving signal generator means for generating a plurality of driving signals corresponding to plural pieces of performance information; and a plurality of loop means for repeatedly circulating the plurality of driving signals by applying at least a delay process and a decay process onto the plurality of driving signals correspondingly to the plural pieces of performance information, to thereby generate a plurality of signals circulating in the respective loops as a plurality of tone signals, with the plurality of loop means put into resonant states respectively, while assigning the plural pieces of performance information to the plurality of loop means, in which not only a piece of performance information of a higher pitch than the highest pitch among signals in already assigned loop means is supplied but the pitch of a signal in a loop means in which a predetermined condition is satisfied is changed in a predetermined range of variation.

When the performance information of a higher pitch than the highest pitch of signals in already assigned loop means is supplied and, at the same time, a predetermined condition is satisfied, the pitch in the corresponding loop means is changed in a predetermined variation.

As described above, a plurality of tones can be generated by an inexpensive and simple structure.

Further, the phase delay quantity of the closed loop in each of physical model tone generators can be corrected without use of a special processor such as a high-speed CPU or a dedicated numeral operation processor.

Further, there is no generation of noise even when parameters for respective constituent elements in each of the physical model tone generators are changed widely.

Further, the performance effects of echo, chorus, etc., can be provided.

Further, the performance style of repeatedly manipulating a string or key in a plucked string instrument such as a guitar in the condition in which the tone of the string or key remains can be simulated without deformation of the waveform of the resulting tone signal.

In addition, the effect of portamento (slur) can be provided.

DESCRIPTION OF THE PREFERRED EMBODIMENTS

To facilitate the understanding of the present invention, a conventional electronic musical instrument will be described hereunder prior to description of the preferred embodiments of the present invention.

Figure 18:
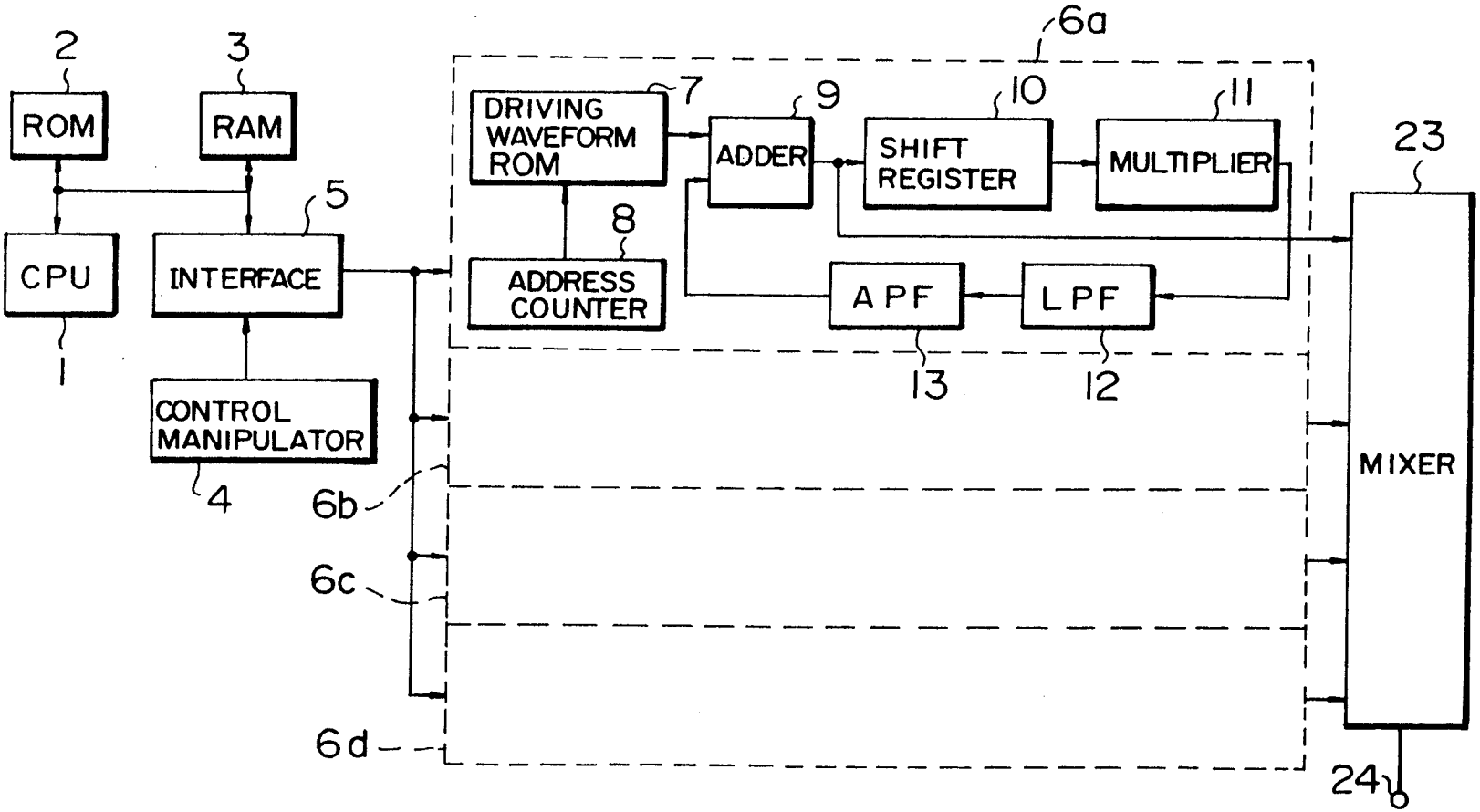
FIG. 18 PRIOR ART
FIG. 18 is a block diagram showing an example of the structure of a conventional electronic musical instrument.

Referring to FIG. 18, there is shown a block diagram of an example of the structure of an electronic musical instrument using four physical model tone generators to generate four tones. In this drawing, the reference numeral 1 designates a central processing unit (hereinafter referred to as "CPU") for controlling various parts of the instrument, 2 a read-only memory (hereinafter referred to as "ROM") for storing control programs used in the CPU 1, 3 an random-access memory (hereinafter referred to as "RAM") for temporarily storing data, 4 a control manipulator such as a keyboard manipulated by a performer, and 5 an interface for receiving data from the control manipulator 4 therethrough and for transferring data to physical model tone generators 6*a* to 6*d* (which will be described later) therethrough.

Figure 19:
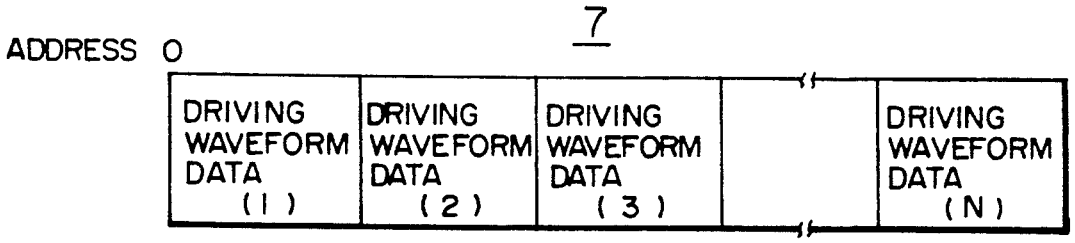
FIG. 19 PRIOR ART
FIG. 19 is a diagram showing an example of the structure of the driving waveform ROM 7 depicted in FIG. 18.

The reference numerals 6*a* to 6*d* designate physical model tone generators as described above. In each physical model tone generator, for example 6*a*, the reference numeral 7 designates a driving waveform ROM for storing N kinds of driving waveform data as shown in FIG. 19. Each of the driving waveform data includes many frequency components such as impulses. The reference numeral 8 designates an address counter for generating a read address for reading data from the driving waveform ROM 7 in response to a tone generation starting instruction of the CPU 1, 9 an adder, 10 a shift register, 11 a multiplier, 12 a low-pass filter (hereinafter referred to as "LPF") constituted by a digital control filter (hereinafter referred to as "DCF") to which parameters such as a cutoff frequency and so on are given to easily and time-divisionally control the characteristic of the filter, and 13 an all-pass filter (hereinafter referred to as "APF") for changing the phase difference between the input signal and the output signal correspondingly to the signal frequency.

Figure 20:
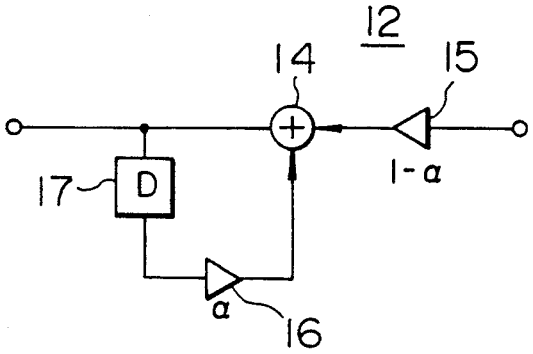
FIG. 20 PRIOR ART
FIG. 20 is a circuit diagram showing an example of the structure of the LPF 12 depicted in FIG. 18.
Figure 21:
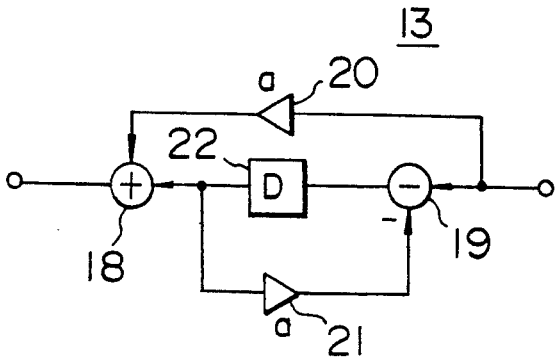
FIG. 21 PRIOR ART
FIG. 21 is a circuit diagram showing an example of the structure of the APF 12 depicted in FIG. 18.

Referring to FIGS. 20 and 21, there are shown an example of the structure of the LPF 12 and an example of the structure of the APF 13. In FIG. 20, the reference numeral 14 designates an adder, 15 a multiplier for multiplying the input signal by a multiplication coefficient $(1-\alpha)$, 16 a multiplier for multiplying the input signal by a multiplication coefficient $\alpha$, and 17 a delay circuit having a delay quantity D. In FIG. 21, the reference numeral 18 designates an adder, 19 a subtracter, 20 and 21 multipliers for multiplying the input signal respectively by multiplication coefficients $\alpha 1$ and a, and 22 a delay circuit having a delay quantity D. Parameters given to the shift register 10, the multiplier 11, the LPF 12 and the APF 13 are controlled by the CPU 1 on the basis of the output data from the control manipulator 4 manipulated by the performer.

In FIG. 18, the reference numeral 23 designates a mixing circuit for mixing tone signals outputted from output terminals of the adders 9 of the physical model tone generators 6a to 6d, and 24 an output terminal for outputting a tone signal mixed by the mixing circuit 23.

In the case where the control manipulator 4 is a keyboard, when, for example, the performer operates the keyboard 4 to depress keys corresponding to the scale of C and the scale of E, key codes KC and key on signals KON corresponding to the respective depressed keys are outputted from the keyboard. Further, initial touches and after touches of the respective depressed keys on the keyboard are detected by a touch input portion not shown and, at the same time, touch data expressing touch strength are generated and outputted therefrom.

Hereby, for example, the CPU 1 assigns the key code KC and the key on signal KON corresponding to the scale of C to the physical model tone generator 6a (hereinafter referred to as "No. 1 channel") and assigns the key code KC and the key on signal KON corresponding to the scale of E to the physical model tone generator 6b (hereinafter referred to as "No. 2 channel") to output the respective key codes and key on signals timely by way of time division.

As described above, the respective parameters given to the LPF 12 and the APF 13 of the physical model tone generator 6 are controlled by the CPU 1 for each key code KC on the basis of the output data from the control manipulator 4 manipulated by the performer. Because the phase delay quantity of the closed loop is changed correspondingly to the parameters given to these filters, the phase delay quantity may be shifted from the delay quantity corresponding to the fundamental pitch to be found. Accordingly, the phase delay quantity needs to be corrected. Therefore, the CPU 1 calculates the multiplication coefficient $\alpha$ (see FIG. 20) of the multipliers 15 and 16 of the LPF 12 as a constituent member of the physical model tone generator 6 on the basis of the key code KC and touch data and further calculates the phase delay quantity Pd of the LPF 12 on the basis of the expression (1):

$$Pd=[\alpha\cdot\sin(fp)/\{1-\alpha\cdot\cos(fp)\}]/fp \quad (1)$$

in which fp represents the fundamental frequency (fundamental pitch) corresponding to the key code KC.

Further, the CPU 1 calculates the parameters for the APF 13 in the same manner as in the LPF 12. The CPU 1 sets a value obtained by subtracting the delay quantity of the LPF 12 and the delay quantity of the APF 13 from the phase delay quantity on the whole closed loop corresponding to the fundamental pitch as the delay quantity of the shift register 10, that is, as the number of delay stages, and then gives a tone generation starting instruction to the physical model tone generators 6a and 6b.

Hereby, in each of the physical model tone generators 6a and 6b, the address counter 8 generates a read address, so that one driving waveform data is successively read from the driving waveform ROM 7 on the basis of the read address and delivered to one input terminal of the adder 9. The output signal from the adder 9 is fed back to the other input terminal of the adder 9 via the shift register 10, the multiplier 11, the LPF 12 and the APF 13. Accordingly, the driving waveform data read from the driving waveform ROM 7 gradually decays while the phase difference between respective frequency components changes as the driving waveform data repeatedly circulates in the closed loop constituted by the route: the shift register 10→the multiplier 11→the LPF 12→the APF 13. As a result, tone signals are picked up from the output terminals of the adders 9 of the physical model tone generators 6a and 6b, mixed by the mixing circuit 23, and then outputted from the output terminal 24 of the mixing circuit 23.

In the case where one released key in the keyboard in the control manipulator 4 is newly depressed in the condition in which the tone of the channel 6 (the reference numeral 6 means one of or each of the physical model tone generators 6a to 6d) assigned for the same key remains in spite of decaying thereof, the CPU 1 searches for the channel assigned for the key and damps the tone rapidly in the timing of the channel (forcing damp). After the completion of the forcing damp, the CPU 1 gives a tone generation starting instruction to a corresponding physical model tone generator 6 again in the timing of the channel. That is, when there is any depressed key, the CPU 1 searches for channels allowed to generate tones. First, the CPU 1 searches for the channel of the same pitch among channels to which key-releases are designated. When there is any channel searched for, the CPU 1 assigns the channel, damps the tone in the closed loop and then makes an instruction to read driving waveform data from the driving waveform ROM 7. On the contrary, when no channel of the same pitch is searched for, the CPU 1 damps the tone of the channel assigned for the oldest released key and then makes an instruction to read driving waveform data from the driving waveform ROM 7.

In the aforementioned conventional electronic musical instrument, the number of driving waveform ROMs must be increased by the number of generated tones because driving waveform ROMs 7 are respectively provided in the physical model tone generators 6a to 6d.

Further, in the aforementioned electronic musical instrument, parameters for the LPF 12, the APF 13 and the like are calculated by arithmetic operation. On the other hand, rapid response is required at the time of tone generation (or in the period of tone generation) to prevent the delay of tone generation. Accordingly, a special processor such as a high-speed CPU 1 or a dedicated numerical operation processor is required for carrying out the arithmetic operation at the time of tone generation (or in the period of tone generation).

Further, in the aforementioned conventional electronic musical instrument, noise may be generated when parameters (such as feedback coefficients and filter coefficients in the closed loop) for the respective constituent members of each physical model tone generator 6 are changed widely, because a discontinuous portion may be formed in the output signal at the time of the changing thereof.

Figure 1:
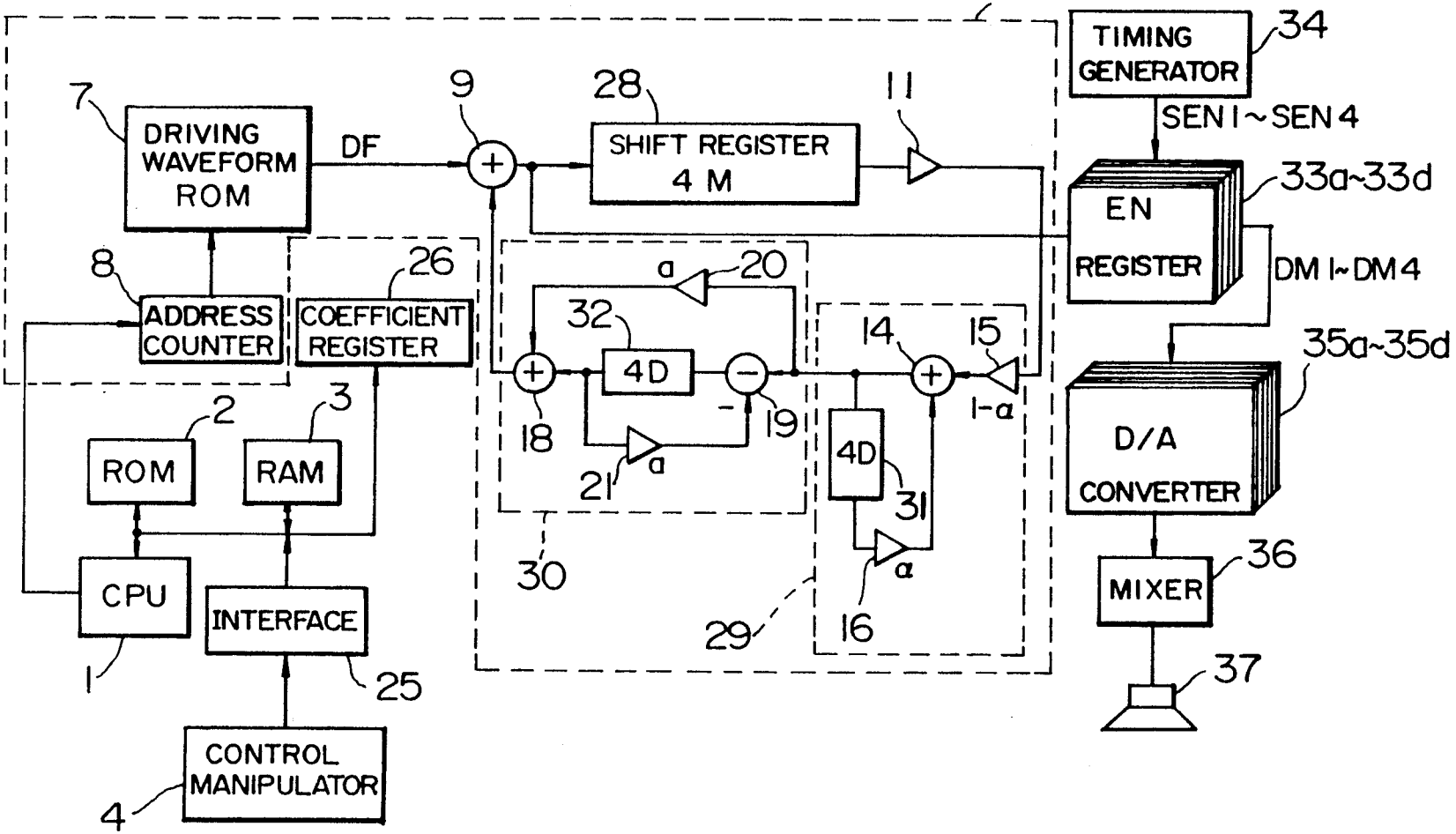
FIG. 1 is a block diagram showing the structure of an electronic musical instrument according to an embodiment of the present invention.

Embodiments of the present invention will be described hereunder with reference to the drawings. FIG. 1 is a block diagram showing the structure of an electronic musical instrument as an embodiment of the present invention. In this drawing, parts corresponding to the parts in FIG. 18 are identified by like numerals. That is, the reference numeral 1 designates a central processing unit (CPU) for controlling respective parts of the instrument, 2 a read-only memory (ROM) for storing control programs used in the CPU 1, 3 an random-access memory (RAM) for temporarily storing data, 4 a control manipulator such as a keyboard manipulated by a performer, 7 a driving waveform ROM for storing driving waveform data and 11 a multiplier. Further, in FIG. 1, the reference numeral 25 designates an interface through which the CPU 1 receives data from the control manipulator 4. The reference numeral 26 designates a coefficient register for storing coefficients, such as the number of delay stages in a physical model tone generator 27 (which will be described later), filter arithmetic operation coefficients and the like, required for tone generation.

Figure 4:
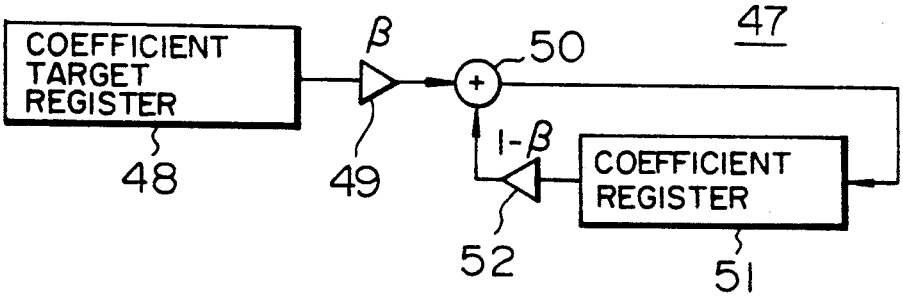
FIG. 4 is a block diagram showing an example of the structure of the coefficient interpolation circuit 47.

The reference numeral 27 designates a physical model tone generator which includes a loop circuit constituted by an adder 9, the multiplier 11, a shift register 28 of 4M delay stages for delaying the input signal by a predetermined delay quantity, a low-pass filter (LPF) 29 and an all-pass filter (APF) 30. In the LPF 29 and the APF 30, the reference numerals 31 and 32 designate delay circuits respectively having the delay quantity 4D. In the number, 4M, of delay stages in the shift register 28 and the delay quantity 4D in each of the delay circuits 31 and 32, M and D respectively represent the number of delay stages and the delay quantity per one tone and the figure 4 represents the number of generated tones. The shift register 28, and the delay circuits 31 and 32 are driven by a quadruple clock and constitute time-divided 4-channel signal paths. That is, even if a frequency-depending phase delay is generated in the APF 30, mixture among signals on the four channels does not occur.

The reference numerals 33*a* to 33*d* designate registers for temporarily storing tone signals outputted from the physical model tone generator 27 by way of time division, 34 a timing generator for generating enable signals SEN1 to SEN4 in predetermined timing to give the enable signals to the registers 33*a* to 33*d*, 35*a* to 35*d* D/A converters for converting tone signals outputted from the registers 33*a* to 33*d* into analog signals, 36 a mixing circuit for mixing the analog signals outputted from the D/A converters 35*a* to 35*d*, and 37 a loud speaker for transducing the tone signal mixed by the mixing circuit 36 into a musical tone.

When, for example, the performer operates the keyboard in the control manipulator 4 in the aforementioned structure to depress keys corresponding to the pitch of C and the pitch of E, key codes KC and key on signals KON corresponding to the depressed keys are outputted from the keyboard. Further, initial touches and after touches of the respective depressed keys in the keyboard are detected by a touch input portion not shown and, at the same time, touch data expressing touch strength are generated and outputted therefrom.

Hereby, for example, the CPU 1 assigns the key code KC and the key on signal KON corresponding to the pitch of C to the No. 1 channel (1ch) and assigns the key code KC and the key on signal KON corresponding to the pitch of E to the No. 2 channel (2ch) and then gives an instruction to the address counter 8 to generate read addresses.

Figure 2:
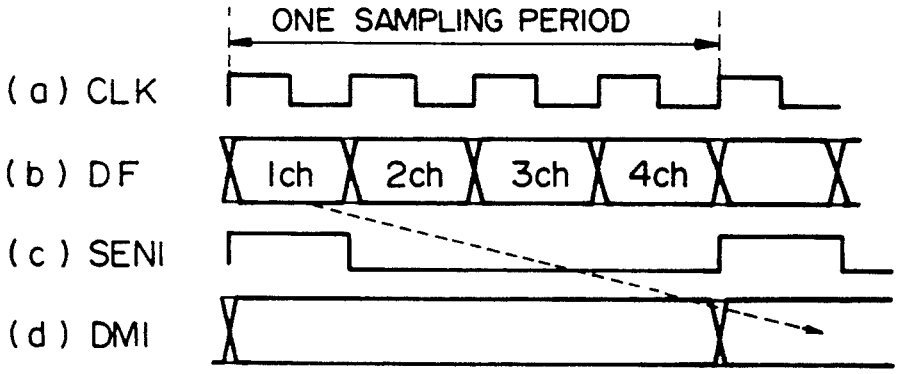
FIG. 2 is a series of graphs showing examples of signal waveforms outputted from respective parts of the instrument depicted in FIG. 1.

Hereby, the address counter 8 generates read addresses, so that driving waveform data DF as shown in the waveform (b) of FIG. 2 are successively read from the driving waveform ROM 7 on the basis of the read addresses by way of time division in the respective timing of the channels in synchronism with the system master clock CLK as shown in the waveform (a) of FIG. 2.

Accordingly, in the physical model tone generator 27, driving waveform data read from the driving waveform ROM for the respective channels are given to one input terminal of the adder 9 by way of time division. The output signal from the adder 9 is fed back to the other input terminal of the adder 9 via the shift register 28, the multiplier 11, the LPF 29 and the APF 30. Hereby, the driving waveform data read from the driving waveform ROM 7 for each of the channels gradually decays while the phase difference between respective frequency components changes as the driving waveform data repeatedly circulates in the closed loop constituted by the route: the shift register 28→the multiplier 11→the LPF 29→the APF 30.

Then, tone signals picked up from the output terminal of the adder by way of time division for the respective channels are temporarily stored in the registers 33*a* and 33*b* on the basis of the enable signals SEN1 and SEN2 outputted from the timing generator 34, respectively. For simplification of description, one SEN1 of the enable signals is shown as the waveform (c) in FIG. 2.

Then, the tone signals DM1 and DM2 temporarily stored in the registers 33*a* and 33*b* for the respective channels are outputted therefrom and converted into analog signals by means of the D/A converters 35*a* and 35*b*. The analog signals are mixed with each other by means of the mixing circuit 36, the resulting mixed signal is transduced into a musical tone by means the speaker 37 and outputted therefrom. For simplification of description, one DM1 of the tone signals is shown as the waveform (d) in FIG. 2.

According to the aforementioned embodiment, the driving waveform ROM can be used in common because there is no necessity of providing driving waveform ROMs each of which a plurality of waveform data are stored for each of physical model tone generators, that is, for each of channels.

Figure 3:
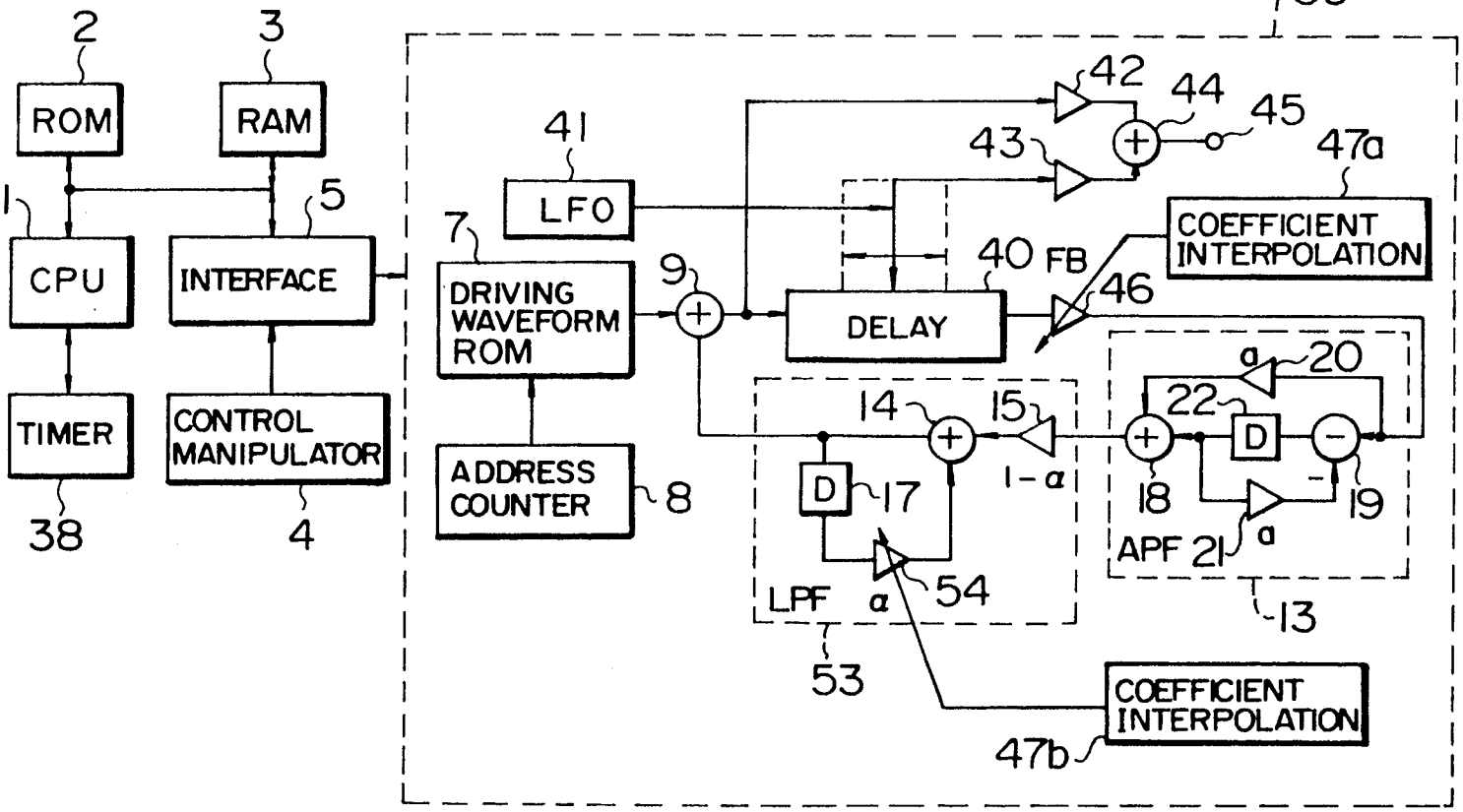
FIG. 3 is a block diagram showing the structure of an electronic musical instrument according to another embodiment of the present invention.

FIG. 3 is a block diagram showing an electronic musical instrument as another embodiment of the present invention. In FIG. 3, the drawing, parts corresponding to the parts in FIG. 1 are identified by like reference numerals and description about those parts is omitted here for simplification of description. The reference numeral 5 designates an interface for receiving data from the control manipulator 4 therethrough and for transferring data to a physical model tone generator 39 therethrough, 13 an all-pass filter, 18 an adder, 19 a subtracter, 20 and 21 multipliers for multiplying the input signal respectively by multiplication coefficients $\alpha$ and a, and 22 a delay circuit having a delay quantity D. The reference numeral 38 designates a timer in which a timer data is set by the CPU 1 so that a timer interrupt pulse is supplied to the CPU 1 whenever a time determined by the timer data passes. In the physical model tone generator 39, the reference numeral 40 designates a delay circuit constituted by a RAM and the like and for delaying the input signal for a predetermined time, 41 a low-frequency oscillation circuit (LFO) for modulating the output delay tap position of the delay circuit 40, 42 a multiplier for multiplying the output signal from the adder 9 by a predetermined multiplication coefficient, 43 a multiplier connected to the output delay tap of the delay circuit 40 and for multiplying the input signal by a predetermined multiplication coefficient, 44 an adder for adding the output signals from the multipliers 42 and 43, and 45 an output terminal through which the output signal from the adder 44, that is, the resulting tone signal, is generated.

The reference numeral 46 designates a multiplier for multiplying the output signal from the delay circuit 40 by a predetermined multiplication coefficient (feedback coefficient FB), and 47*a* a coefficient interpolation circuit for interpolating the feedback coefficient FB of the multiplier 46. An example of the structure of the coefficient interpolation circuit 47 (the reference numeral 47 means each of the coefficient interpolation circuit 47*a* and another coefficient interpolation circuit 47*b* which will be described later) is shown in FIG. 4. In FIG. 4, the reference numeral 48 designates a coefficient target register for storing the feedback coefficient FB as a target transferred through the interface 5 by the CPU 1, 49 a multiplier for multiplying the feedback coefficient FB stored in the coefficient target register 48 by an interpolation coefficient $\beta$, 50 an adder, 51 a coefficient register for storing the value of a present coefficient, and 52 a multiplier for multiplying the present coefficient value stored in the coefficient register 51 by an interpolation coefficient $(1-\beta)$.

Returning to FIG. 3, the reference numeral 53 designates a low-pass filter (LPF) including a multiplier 54 provided instead of the multiplier 16 (see FIG. 20) in the LPF 12 of FIG. 18. The multiplier 54 multiplies the output signal from the delay circuit 17 by a predetermined multiplication factor $\alpha$ which is interpolated by the coefficient interpolation circuit 47*b*.

Figure 5:
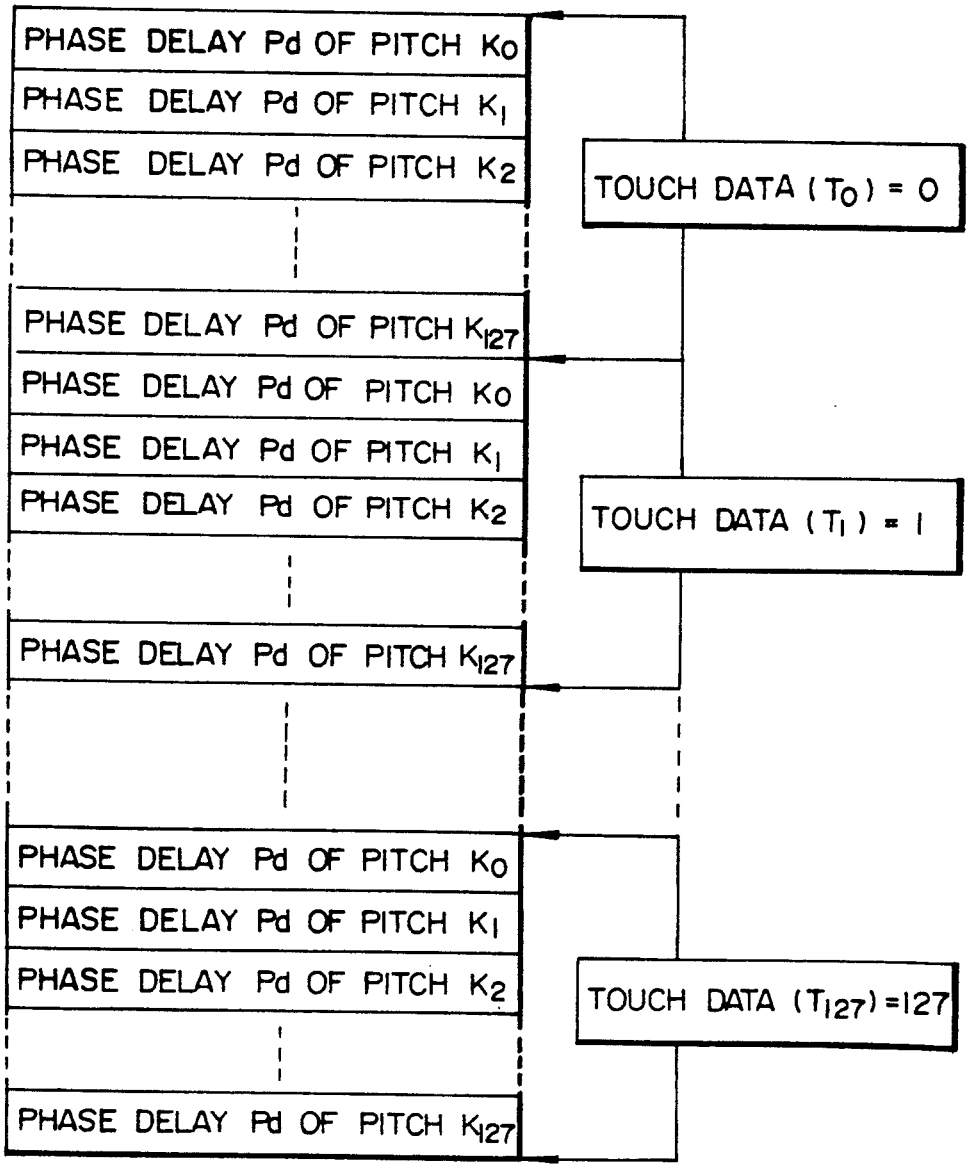
FIG. 5 is a view showing an example of the table having values of phase delay quantities corresponding to pitch and touch in the LPF 53 depicted in FIG. 3.

As shown in FIG. 5, various values, such as the value of the phase delay quantity Pd of the LPF 53, the value of the multiplication coefficient $\alpha$ of the multipliers 15 and 54, the value of the phase delay quantity of the APF 13, the multiplication coefficient a of the multipliers 20 and 21, etc., corresponding to the MIDI information, such as the note number K0–K127 (which corresponds to the pitch) and the note-on/off velocity T0–T127 (which corresponds to the touch data), given from the control manipulator 4 through the interface 5 are calculated on the basis of the aforementioned expression (1) or the like and stored in the ROM 2 or in the RAM 3 of FIG. 3 in advance.

When, for example, the performer operates the keyboard of the control manipulator 4 in the aforementioned structure to depress a key corresponding the pitch of C, the note-on data corresponding to the pitch of C, that is, the note number K60 and the note-on velocity T60 are outputted from the keyboard.

Hereby, the CPU 1 calculates various values, such as the feedback coefficient FB of the multiplier 46, the value of the phase delay quantity Pd of the LPF 53, the value of the multiplication coefficient $\alpha$ of the multipliers 15 and 54 of the LPF 53, the value of the phase delay quantity of the APF 13, the value of the multiplication coefficient a of the multipliers 20 and 21, etc., corresponding to the note number K60 and the note-on velocity T60 by reference to the table (or the like) in the ROM 2 or in the RAM 3 shown in FIG. 5. Then, the CPU 1 sets as the delay quantity of the delay circuit 40 a value obtained by subtracting the delay quantity of the LPF 53 and the delay quantity of the APF 13 calculated by reference to the table, from the phase delay quantity of the whole closed loop of the physical model tone generator 39 corresponding to the pitch of C. Among the aforementioned parameters, the feedback coefficient FB of the multiplier 46 and the multiplication coefficient $\alpha$ of the LPF 53 are stored in the coefficient target register 48 of the coefficient interpolation circuit 47*a* and the coefficient target register 48 of the coefficient interpolation circuit 47*b*, respectively.

Then, the CPU 1 gives a tone generation starting instruction to the physical model tone generator 39. Hereby, in the physical model tone generator 39, the address counter 8 generates a read address, so that one driving waveform data is successively read from the driving waveform ROM 7 on the basis of the read address and delivered to one input terminal of the adder 9. The output signal from the adder 9 is fed back to the other input terminal of the adder 9 via the delay circuit 40, the multiplier 46, the APF 13 and the LPF 53. Accordingly, the driving waveform data read from the driving waveform ROM 7 gradually decays while the phase difference between respective frequency components changes as the driving waveform data repeatedly circulates in the closed loop constituted by the route: the delay circuit 40→the multiplier 46→the APF 13→the LPF 13. At this time, the feedback coefficient FB of the multiplier 46 changes from the present value stored in the coefficient register 51 to the value stored in the coefficient target register 48 at an interpolation speed $\beta$ in the coefficient interpolation circuit 47*a*. On the other hand, the multiplication coefficient $\alpha$ of the LPF 53 changes from the present value stored in the coefficient register 51 to the value stored in the coefficient target register 48 at an interpolation speed $\beta'$ in the coefficient interpolation circuit 47*b*.

The output signal from the adder 9 is multiplied by a predetermined multiplication coefficient in the multiplier 42, and the resulting signal is fed to one input terminal of the adder 44. The output signal modulated by the LPF 41, at the output delay tap position of the delay circuit 40, is multiplied by a predetermined multiplication coefficient in the multiplier 43, and the resulting signal is fed to the other input terminal of the adder 44. As a result, the output signal from the adder 44, that is, a tone signal, is generated from the output terminal 45.

According to the aforementioned second embodiment, the process of calculating coefficients and phase delay quantities of the LPF and APF at the time of tone generation can be simplified by referring to the tables. Accordingly, the tone generating process can be carried out speedily without use of any special processor such as a high-speed CPU or a dedicated numerical operation processor. Further, because respective coefficients of constituent elements of the physical model tone generator 39 are interpolated by using the coefficient interpolation circuit 47, no discontinuous point arises in the signal circulating in the closed loop at the time of the changing of the coefficients even when the coefficients change widely. Accordingly, when the tone signal generated from the output terminal 45 is reproduced, there is no noise. Further, because the tone signal is obtained by processing two output signals from the adder 9 and the output delay tap of the delay circuit 40, that is, because the tone signal is obtained through picking up a plurality of signals from the closed loop of one physical model tone generator 39, the effect of echo can be achieved. Further, because the output delay tap position of the delay circuit 40 is modulated by the LFO 41, the effect of chorus can be achieved.

Although the aforementioned second embodiment has shown the case where MIDI information is outputted from the control manipulator 4, it is a matter of course that the invention is not limited thereto and that any suitable data can be used as long as the data can be generated on the basis of the performer's manipulation.

Figure 6:
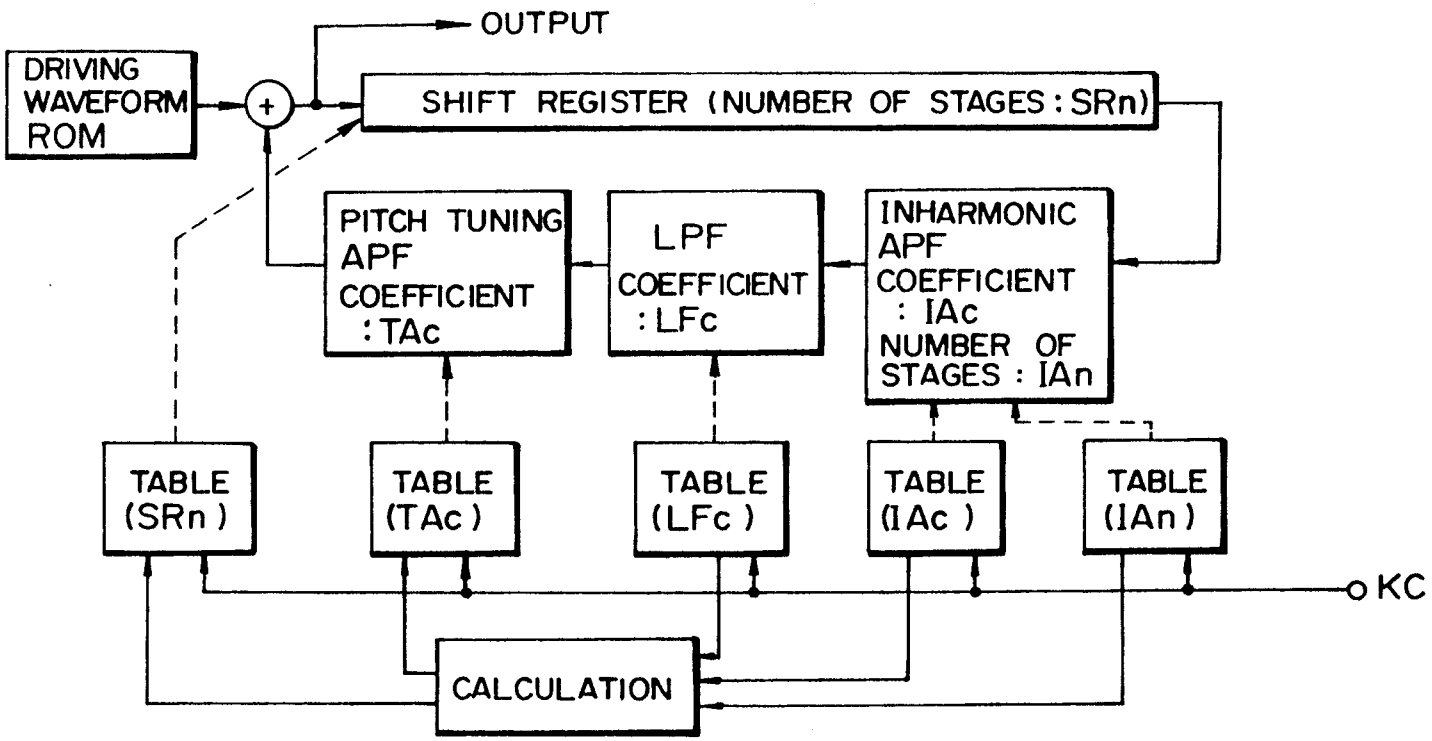
FIG. 6 is a block diagram showing the structure of important parts of an electronic musical instrument according to a still further embodiment of the present invention.

Although the aforementioned second embodiment has shown the case where the table as shown in FIG. 5 is stored in the ROM 2 or RAM 3 in FIG. 3 in advance, the invention is not limited thereto. For example, as shown in FIG. 6, tables for respective parameters may be provided in the physical model tone generator so that these tables can be referred to on the basis of the key code KC at the time of tone generation. The procedure of generating respective tables will be described hereunder.

(a) The coefficient IAc of an inharmonic APF inserted to synthesize a musical tone having an inharmonic structure, the number IAn of stages therein and the coefficient LFc of an LPF are set for each key to generate respective tables.

(b) The phase delay quantities of the inharmonic APF and LPF are calculated for each key.

(c) The integral and decimal portions of the delay quantity obtained by subtracting the phase delay quantities of the inharmonic APF and LPF calculated by (b) from the total delay quantity of the whole closed loop of the physical model tone generator determined on the basis of the fundamental frequency of the key are respectively set as the value of the number SRn of stages in a shift register and the value of the coefficient TAc of a pitch tuning APF for each key, to thereby generate respective tables.

Although the aforementioned second embodiment has shown the case where the values of respective coefficients such as the coefficient $\alpha$ of the LPF 53 are interpolated by using the coefficient interpolation circuit 47, the invention can be applied to the case where respective coefficients interpolated by the CPU 1 may be transferred to the physical model tone generator 39.

Figure 7:
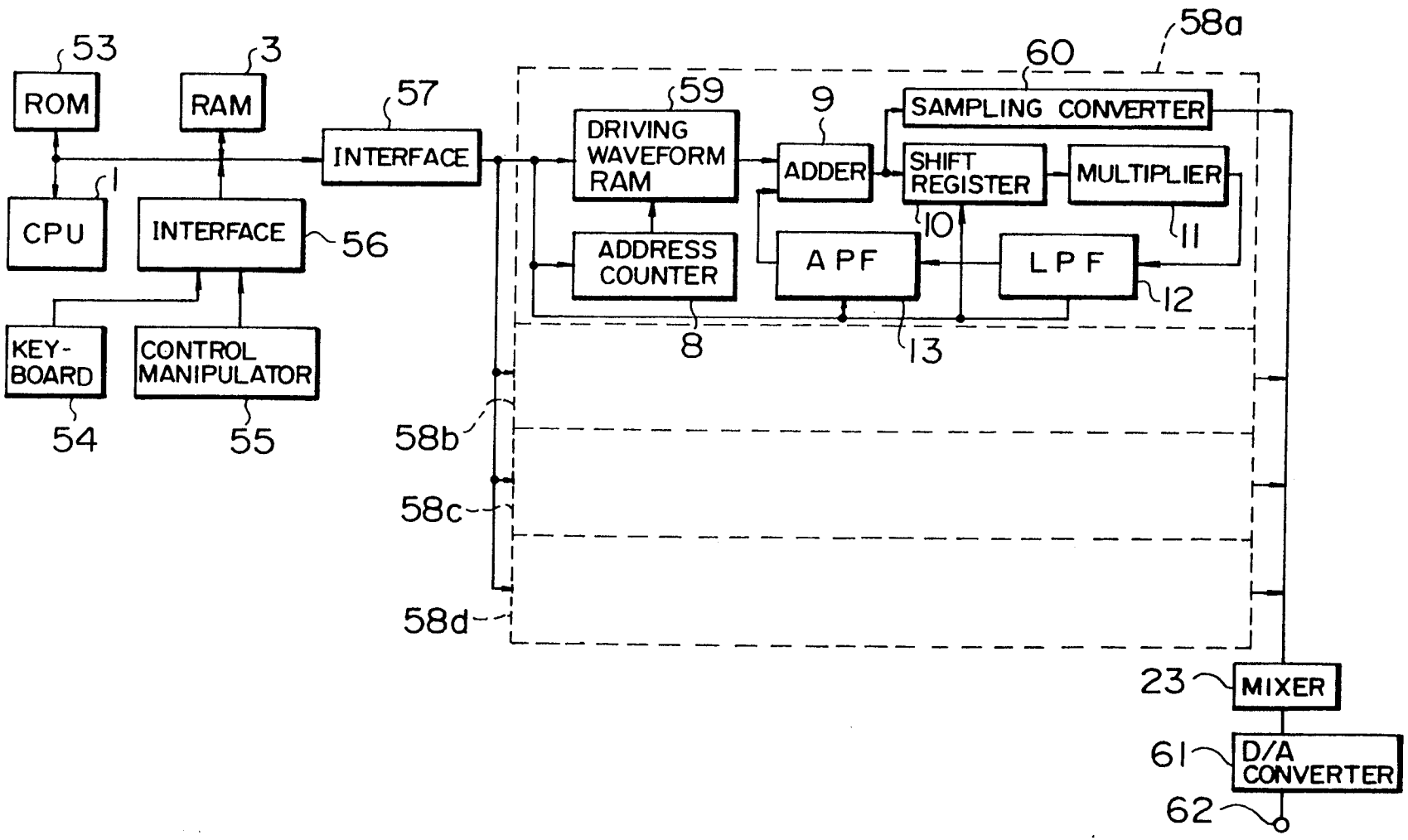
FIG. 7 is a block diagram showing the structure of an electronic musical instrument according to another embodiment of the present invention.

The third embodiment of the present invention will be described hereunder. FIG. 7 is a block diagram showing the structure of an electronic musical instrument as the third embodiment of the invention. In the drawing, parts corresponding to the parts in FIG. 18 are identified by like reference numerals and description about those parts is omitted here for simplification of description. In the electronic musical instrument shown in FIG. 7, driving waveform data are stored in an ROM in which CPU 1 control programs for controlling tone generation are stored, so that the driving waveform data are transferred to respective physical model tone generators at the time of tone generation (or at the time of tone color switching) to generate four tones in parallel. In the electronic musical instrument shown in FIG. 7, a multi-sampling method is used as a measure counter to the changes of respective parameters of the constituent elements of the aforementioned physical model tone generators corresponding to the pitch. This multi-sampling method is a method in which the number of delay stages in the shift register is changed against the rough pitch change such as an octave and in which the variable sampling frequency synchronized with the pitch (C-B) within an octave is changed against the fine pitch change. As to the details of the multi-sampling method, an electronic musical instrument which has been proposed by this Applicant (Japanese Patent Postexamin. Publication No. Sho-58-58678) is incorporated by reference.

Figure 8:
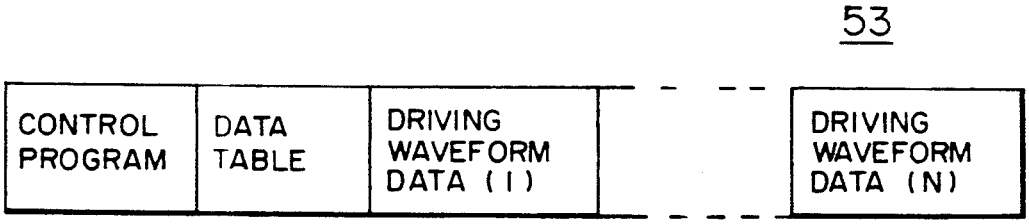
FIG. 8 is a diagram showing an example of the structure of the ROM 53 depicted in FIG. 7.

In FIG. 7, the reference numeral 53 designates a ROM. As shown in FIG. 8, control programs used in the CPU 1, data tables (similar to the table in the second embodiment) in which various data such as the number of delay stages and filter operation coefficients in the physical model tone generators 58 (which will be described later) and N kinds of driving waveform data are stored in the ROM 53. The reference numeral 54 designates a keyboard having a plurality of keys, 55 a control manipulator except the keyboard manipulated by a performer, and 56 an interface through which the CPU 1 receives data from the keyboard 54 and the control manipulator 55. The reference numeral 57 designates an interface through which the CPU 1 transfers data to each physical model tone generator 58 (the reference numeral 58 means one of or each of physical model tone generator 58*a* to 58*d* which will be described later).

The physical model tone generators 58*a* to 58*d* each of which is different in structure from that shown in FIG. 18 in that a driving waveform RAM 59 is newly provided instead of the driving waveform ROM 7 and in that a sampling converter circuit 60 is newly provided. One of the driving waveform data stored in the ROM 53 is transferred to the RAM 59 at the time of tone generation (or at the time of tone color switching) and stored therein. The sampling converter circuit 60 converts the variable sampling frequency Fa of the output signal from the adder 9 into a fixed sampling frequency Fs of the system. For example, the sampling conversion is carried out by thinning out data after oversampling. Each physical model tone generator 58 is constituted by a digital signal processor (DSP). Part or all of the micro-program used in the physical model tone generator 58 is stored in the ROM 53 in advance.

The reference numeral 61 designates a D/A converter for converting a tone signal mixed by a mixing circuit 23 into an analog tone signal, and 62 an output terminal through which the output signal from the D/A converter 61 is generated.

Figure 9:
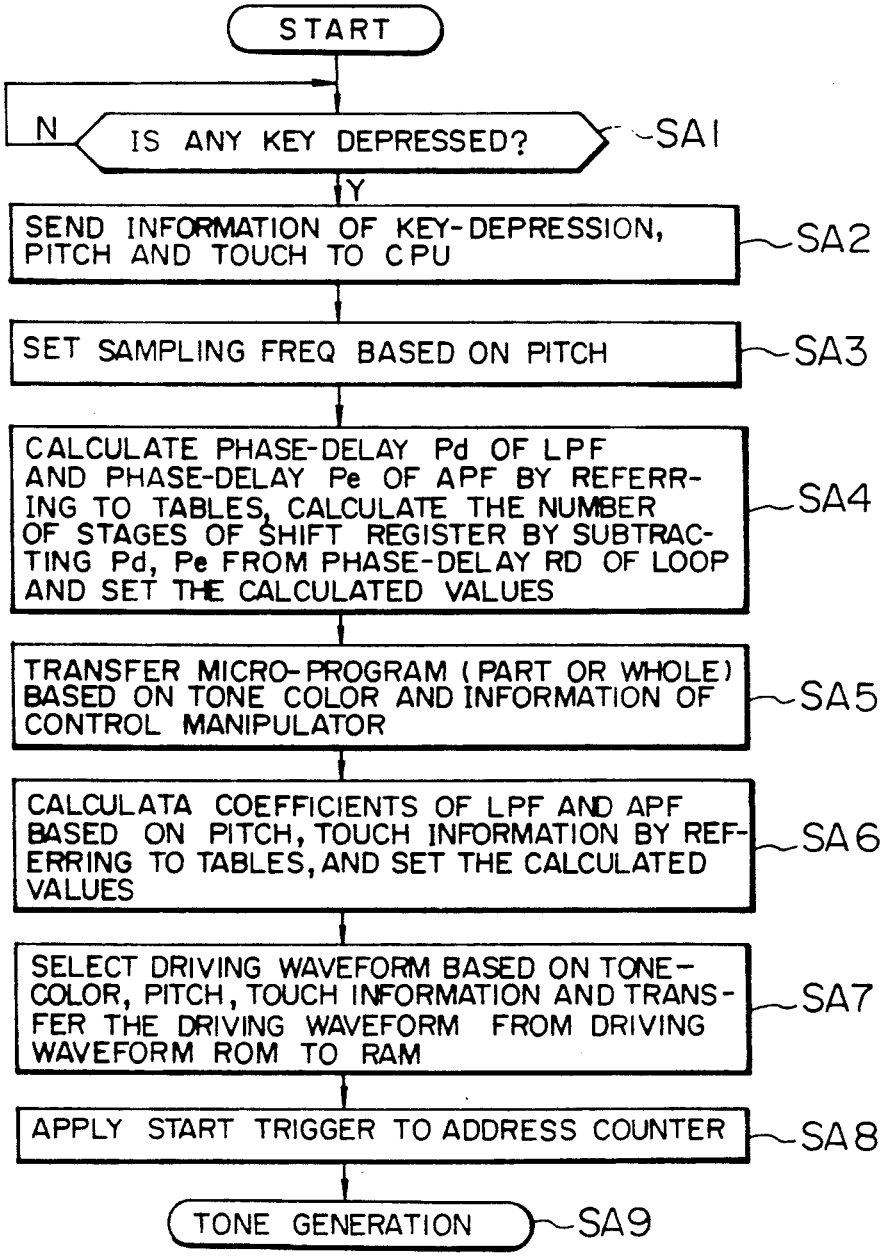
FIG. 9 is a flow chart showing the operation of the electronic musical instrument depicted in FIG. 7.

The operation of the electronic musical instrument in the aforementioned structure in the case where the performer operates the keyboard 54 to depress keys will be described hereunder with reference to a flow chart shown in FIG. 9.

When the routine starts, the situation thereof goes to a step SA1. In the step SA1, a judgment is made as to whether there is any key depressed in the keyboard 54. While the judgment results in "NO", the same judgment is repeated. When, for example, the performer now operates the keyboard 54 to depress keys corresponding to the pitch of C and the pitch of E, the judgment in the step SA1 results in "YES" and the situation of the routine goes to a step SA2.

In the step SA2, information of key depression, pitch and touch corresponding to the keys corresponding to the pitch of C and the pitch of E is transferred to the CPU 1 from the keyboard 54 and then the situation of the routine goes to a step SA3.

For example, in the step SA3, the CPU 1 assigns information of key depression, pitch and touch corresponding to the scale of C to the physical model tone generator 58*a* (No. 1 channel) and information of key depression, pitch and touch corresponding to the scale of E to the physical model tone generator (No. 2 channel) and then sets the sampling frequency Fa on the basis of the pitch. Then the situation of the routine goes to a step SA4.

In the step SA4, the CPU 1 calculates both the phase delay quantity Pd of the LPF 12 and the phase delay quantity Pe of the APF 13 in each of the physical model tone generators 58*a* and 58*b* by reference to the data tables stored in the ROM 53 and further calculates the number of delay stages in the shift register 10 in each of the physical model tone generators 58*a* and 58*b* by subtracting the phase delay quantity Pd of the LPF 12 and the phase delay quantity Pe of the APF 13 from the phase delay quantity RD of the whole closed loop in each of the physical model tone generators 58*a* and 58*b* correspondingly to the pitch and sets the respective values. Then, the situation of the routine goes to a step SA5.

In the step SA5, the CPU 1 transfers part or all of the micro-program to the respective physical model tone generators 58*a* and 58*b* on the basis of the tone color and information outputted from the control manipulator 55. Then, the situation of the routine goes to a step SA6.

In the step SA6, the CPU 1 calculates the coefficient of the LPFs 12 and 13 in each of the physical model tone generators 58*a* and 58*b* on the basis of the information of pitch and touch by reference to the data tables stored in the ROM 53 and sets the coefficient. Then, the situation of the routine goes to a step SA7.

In the step SA7, driving waveform data are selected one by one from the N driving waveform data stored in the ROM 53 on the basis of the information of tone color, pitch and touch and respectively transferred to the physical model tone generators 58*a* and 58*b*. Then, the situation of the routine goes to a step SA8.

In the step SA8, the CPU 1 applies a start trigger to the address counter 8 in each of the physical model tone generators 58*a* and 58*b* to give an instruction thereto to generate a read address. Then, the situation of the routine goes to a step SA9.

In the step SA9, the physical model tone generators 58*a* and 58*b* carry out tone generation by using sampling frequencies Fa synchronized with the pitches, that is, the scale of C and the scale of E, respectively. That is, the address counter 8 generates read addresses, so that driving waveform data are successively read from the driving waveform RAM 59 on the basis of the read addresses.

Accordingly, in each of the physical model tone generators, the driving waveform data read from the driving waveform RAM 59 is fed to one input terminal of the adder 9. The output signal from the adder 9 is fed back to the other input terminal via the shift register 10, the multiplier 11, the LPF 12, and the APF 13. Hereby, the driving waveform read from the driving waveform RAM 59 gradually decays while the phase difference between respective frequency components of the signal changes as the driving waveform repeatedly circulates in the closed loop constituted by the route: the shift register 10→the multiplier 11→the LPF 12→the APF 13.

Then, the tone signal obtained from the output terminal of the adder 9 is outputted after the variable sampling frequency Fa is converted into a fixed sampling frequency Fs of the system.

Tone signals outputted from the physical model tone generators 58*a* and 58*b* are mixed with each other by the mixing circuit 23. The mixed signal is converted into an analog signal by the D/A converter 61. The analog signal is outputted from the output terminal 62.

Also in the case where the aforementioned multi-sampling method is used, filters in the closed loop in each physical model tone generator 58 requires keeping the characteristics constant in spite of the pitch change. In the case where the multi-sampling method is used, however, the characteristics (such as a cutoff frequency) of the filters change if the coefficients of the filters are fixed, because the sampling frequency changes in the closed loop in each physical model tone generator 58. Therefore, it is necessary to correct the coefficients of the filters correspondingly to the change of the pitch, that is, correspondingly to the change of the sampling frequency. A method of correcting the coefficients of the filters in each physical model tone generator 58 in the case where the multi-sampling method is used will be described hereunder.

In the aforementioned multi-sampling method, the octave switching is carried out by raising the delay length (the number of delay stages) of the shift register 10 with the power of 2. Accordingly, whenever the pitch is raised by one octave, the delay length of the closed loop in each of the physical model tone generators 58 is set to be halved. The same condition is, however, required in the boundary in which the delay length and the sampling frequency Fa are switched over to each other. The same condition can be satisfied in the boundary if the same tone can be obtained when both the delay length and the number of arithmetic operations are halved.

(1) Closed Loop Gain

When the delay length is halved, the distance that the signal moves in the closed loop increases by two times but the number of arithmetic operations is halved. Accordingly, there is consequently no necessity of coefficient correction. Assuming now that a constant coefficient is given to a filter, the decay time constant $\tau$ is proportional to the reciprocal (period T) of the frequency of the pitch as represented by the following expression (2).

$$\tau \propto 1/f = T \quad (2).$$

Consequently, it is equivalent to the rate key scale of 6 dB/OCT.

(2) Cutoff Coefficient of Filter in Closed Loop

Figure 10:
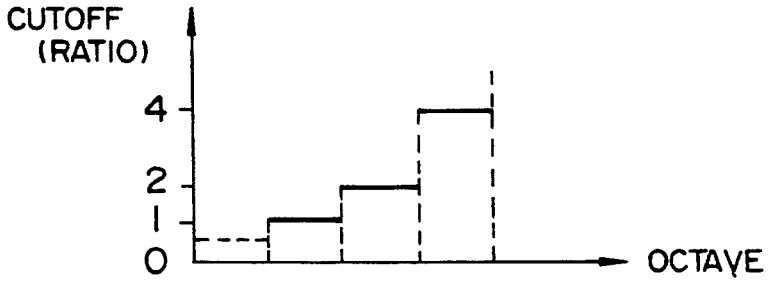
FIG. 10 is a graph for explaining the relation between octave and cutoff in the multi-sampling method.

When the coefficient is constant, the sampling frequency Fa and the cutoff coefficient are proportional to each other. That is, when the pitch is raised by an octave, the cutoff coefficient increases by two times. On the other hand, the probability of arithmetic operations does not change in the boundary, because the ratio of the number of arithmetic operations to the delay length is constant. Consequently, it is considered that the cutoff frequency fc and the filter coefficient $\alpha$ are proportional to each other whenever the pitch is raised by an octave, as represented by the following expression and as shown in FIG. 10. Strictly speaking, correction is required.

$$\alpha \simeq 2\pi fc/fa \quad (3).$$

(3) Correction of Coefficient of FIR Filter

Although the aforementioned third embodiment has shown the case where the LPF 12 is constituted by a DCF, it is difficult to correct the coefficient in the case where the LPF 12 is constituted by an FIR filter (acyclic filter). This is because the coefficient of the DCF filter changes substantially analogously to the logarithmic change of the frequency whereas the coefficient of the FIR filter does not change analogously to the logarithmic change of the frequency. Even when the shoulder characteristic of the filter is adjusted by correcting the coefficient thereof, the same characteristic cannot be obtained because the gain in the vicinity of the Nyquist frequency changes widely. To correct the coefficient boldly, the coefficient is selected so that the cutoff frequency increases by two times whenever the pitch is raised by an octave, in the same manner as in the case of (2).

According to the aforementioned third embodiment, one driving waveform ROM can be used in common because there is no necessity of providing a plurality of driving waveform ROMs for storing a plurality of driving waveform data for each physical model tone generator, that is, for each channel. Further, because each physical model tone generator 58 is constituted by a DSP, a wider variation of tone color than the conventional variation can be obtained by the operation of the CPU 1 of transferring not only driving waveform data but part or all of the micro-program to each physical model tone generator 58 because the structure of the physical model tone generator 58 can be changed so dynamically that the arrangement of the LPF 12 and APF 13 can be changed.

Although the aforementioned third embodiment has shown the case where the CPU 1 transfers driving waveform data to each physical model tone generator 58, the invention can be applied to the case where the driving waveform data may be transferred to each physical model tone generator 58 directly from the ROM 53 regardless of the CPU 1.

Although the aforementioned third embodiment has shown the case where the driving waveform data are stored in the ROM 53 in advance, the invention can be applied to the case where the CPU 1 may carry out an arithmetic operation process in advance to make the RAM 3 store the result of the arithmetic operation so that the result of the arithmetic operation can be used as the driving waveform data transferred to each physical model tone generator 58 at the time of tone generation.

Although the aforementioned third embodiment has shown the case where an arbitrary pitch is provided by changing both the variable sampling frequency Fa and the number of delay stages in the shift register 10, the invention can be applied to the case where an arbitrary pitch may be provided by changing the variable sampling frequency Fa proportionally to the target pitch when the sampling frequency is very high.

Figure 11:
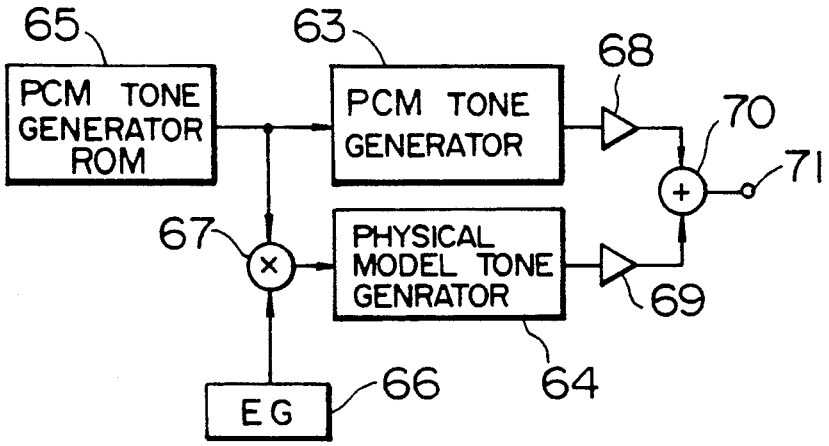
FIG. 11 is a block diagram showing the structure of important parts of an electronic musical instrument according to a further embodiment of the present invention.

The fourth embodiment of the present invention will be described hereunder. FIG. 11 is a block diagram showing the structure of important parts of an electronic musical instrument as the fourth embodiment of the present invention. The electronic musical instrument shown in FIG. 11 uses both a PCM tone generator 63 and a physical model tone generator 64 as tone generators. In the PCM tone generator 63, PCM waveform data stored in a PCM tone generator ROM 65 are read in synchronism with a clock pulse signal corresponding to the performer's manipulation of a keyboard (not shown) or the like. The physical model tone generator 64 is provided by removing both the driving waveform ROM 7 and the address counter 8 from the aforementioned conventional physical model tone generator 6. It is a matter of course that the structure of the physical model tone generator 64 is not limited to the specific embodiment and that any tone generator may be used as long as it can synthesize musical tones of a natural musical instrument as output data from input waveform data.

Figure 12:
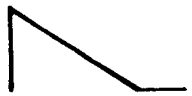
FIG. 12 is a waveform view showing an example of the envelope signal outputted from the EG 66 depicted in FIG. 11.

In FIG. 11, the reference numeral 66 designates an envelope generator (EG) for generating an envelope signal (see FIG. 12) for controlling the amplitude of a tone signal to thereby control the volume and tone color of the tone signal, 67 a multiplier for multiplying the waveform data read from the PCM tone generator waveform ROM 65 by the envelope signal, 68 a multiplier for multiplying the output signal from the PCM tone generator 63 by a predetermined multiplication coefficient, 69 a multiplier for multiplying the output signal from the physical model tone generator 64 by a predetermined multiplication coefficient, 70 an adder for adding the output signals from the multipliers 68 and 69, and 71 an output terminal through which the output signal from the adder 70, that is, the resulting tone signal, is outputted.

When, for example, the performer operates the keyboard in the aforementioned structure to depress a key, a key code KC, a key on signal KON, etc., corresponding to the key are outputted. Hereby, the CPU (not shown) sets parameters of respective constituent elements constituting a closed loop of the physical model tone generator 64 correspondingly to the key code KC, the key on signal KON, etc., and then gives a tone generation starting instruction both to the PCM tone generator 63 and to the physical model tone generator 64 and at the same time controls the EG 66.

Hereby, the PCM tone generator 63 reads waveform data from the PCM tone generator ROM 65 in synchronism with the clock pulse signal corresponding to the data such as the key code KC, the key on signal KON, etc. In the multiplier 67, a part of the waveform data read from the PCM tone generator ROM 65 is multiplied by the envelope signal outputted from the EG 66. Then, the multiplied signal is supplied to the physical model tone generator 64.

In the physical model tone generator 64, the output signal from the multiplier 67 is subjected to the same process as in the physical model tone generator 39 shown in FIG. 3, so that the signal gradually decays while the phase difference between respective frequency components changes.

Then, the signal picked up from the physical model tone generator 64 is multiplied by a predetermined multiplication coefficient in the multiplier 69. The multiplied signal is fed to one input terminal of the adder 70. On the other hand, the signal picked up from the PCM tone generator 63 is multiplied by a predetermined multiplication coefficient in the multiplier 68, the multiplied signal is fed to the other input terminal of the adder 70. As a result, the output signal from the adder 70, that is, a tone signal, is outputted through the output terminal 71.

According to the aforementioned fourth embodiment, the PCM tone generator ROM 65 can be used in common to the PCM tone generator 63 and the physical model tone generator 64.

In the aforementioned conventional electronic musical instrument, when a released key is depressed newly in the condition in which the tone of the channel (physical model tone generator 6) assigned for the released key in the keyboard in the control manipulator 4 decays but remains, the CPU 1 searches for the channel assigned for the key. When the channel of the same pitch is searched for, the CPU 1 carries out a forcing damp process to damp the remaining signal in the timing of the channel and then gives a tone generation starting instruction to the physical model tone generator 64 again in the timing of the channel.

Accordingly, the performance style in which vibration energy is further applied to a resonant substance such as a rumbling string as the same string or key is repeatedly manipulated in the condition in which the tone of the string or key remains as a plucked string instrument such as guitar is performed in the style of repeatedly plucking a string, cannot be simulated perfectly.

Therefore, when a released key is depressed newly in the condition in which the tone of the channel assigned for the released key decays but remains, the electronic musical instrument is arranged so that the driving waveform data is supplied into the closed loop in the condition in which the tone remains in the closed loop of the physical model tone generator. In other words, the channel of the same pitch is searched for among channels assigned for released keys when channels allowed to generate tones are searched for in response to the key depression, so that when the channel is found, the channel is assigned to input the driving waveform in the condition in which the tone remains in the closed loop. Hereby, the aforementioned performance style can be simulated.

In this method, however, when depression and release of one key are repeated continuously, the key is always assigned to the same channel. Accordingly, because the signal remaining in the closed loop is accumulated by the inputting of the driving waveform data, the signal in the closed loop finally overflows. As a result, the waveform of the tone signal is deformed to a distorted waveform.

Therefore, the fifth embodiment of the invention by which not only the aforementioned performance style can be simulated while the aforementioned problem is solved but the effect of portamento (slur) can be provided will be described hereunder. The effect of portamento herein used means the effect of simulating various performance styles in the guitar or the like, such as the slide style of sliding the finger pressing a string to change the pitch, the hammering-on style of hammering a string by a left-hand finger to provide the effect of upward slur, the pulling-off style of pulling off a string by a left-hand finger to provide the effect of downward slur without plucking the string by the right hand, and the like.

Figure 13:
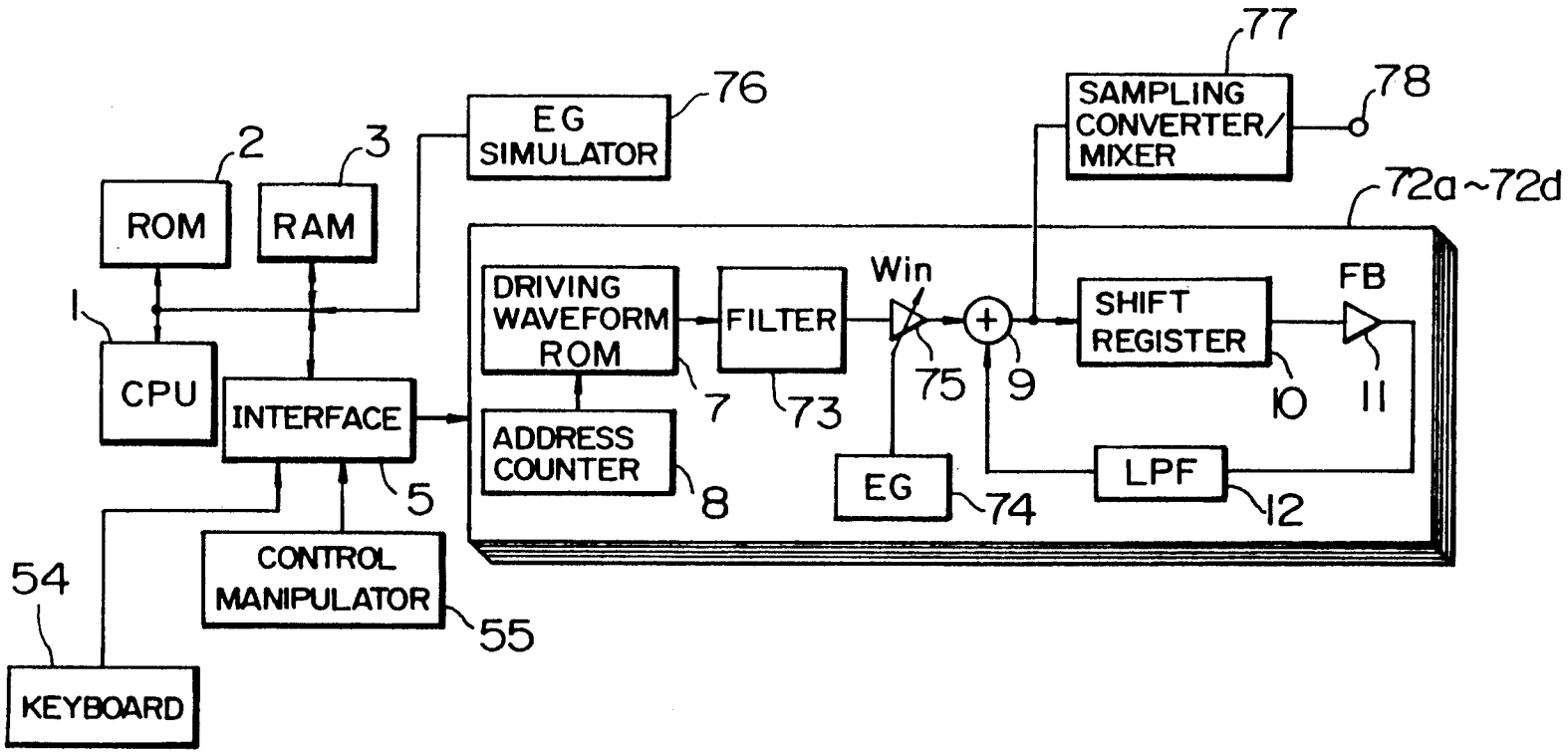
FIG. 13 is a block diagram showing the structure of an electronic musical instrument according to a still further embodiment of the present invention.

FIG. 13 is a block diagram showing the structure of an electronic musical instrument as the fifth embodiment of the invention. In the drawing, parts corresponding to the parts in the previous embodiment are identified by like reference numerals and description about them is omitted here for simplification of description. In FIG. 13, the reference numerals 72*a* to 72*d* designate physical model tone generators. In each physical model tone generator 72 (there reference numeral 72 means one of or each of the physical model tone generators 72*a* to 72*d*), the reference numeral 73 designates a filter for giving a predetermined characteristic to driving waveform data read from the driving waveform ROM 7, 74 an EG and 75 a multiplier for multiplying the output signal from the filter 73 by the envelope signal outputted from the EG 74. Further, the reference numeral 76 designates an EG simulator in which the level of the signal circulating in the closed loop in each physical model tone generator 72 is detected. The reference numeral 77 designates a sampling converter/mixing circuit for converting the variable sampling frequency Fa for the output signal from each of the physical model tone generators 72*a* to 72*d* into a fixed sampling frequency Fs of the system and for mixing the output signals from the physical model tone generators 72*a* to 72*d*. The reference numeral 78 designates an output terminal of the sampling converter/mixing circuit 77, that is, an output terminal for generating the resulting tone signal.

The operation of the CPU 1 in the case where the performer manipulates a key in the keyboard 54 will be described with reference to flow charts shown in FIGS. 14 through 17.

Figure 14:
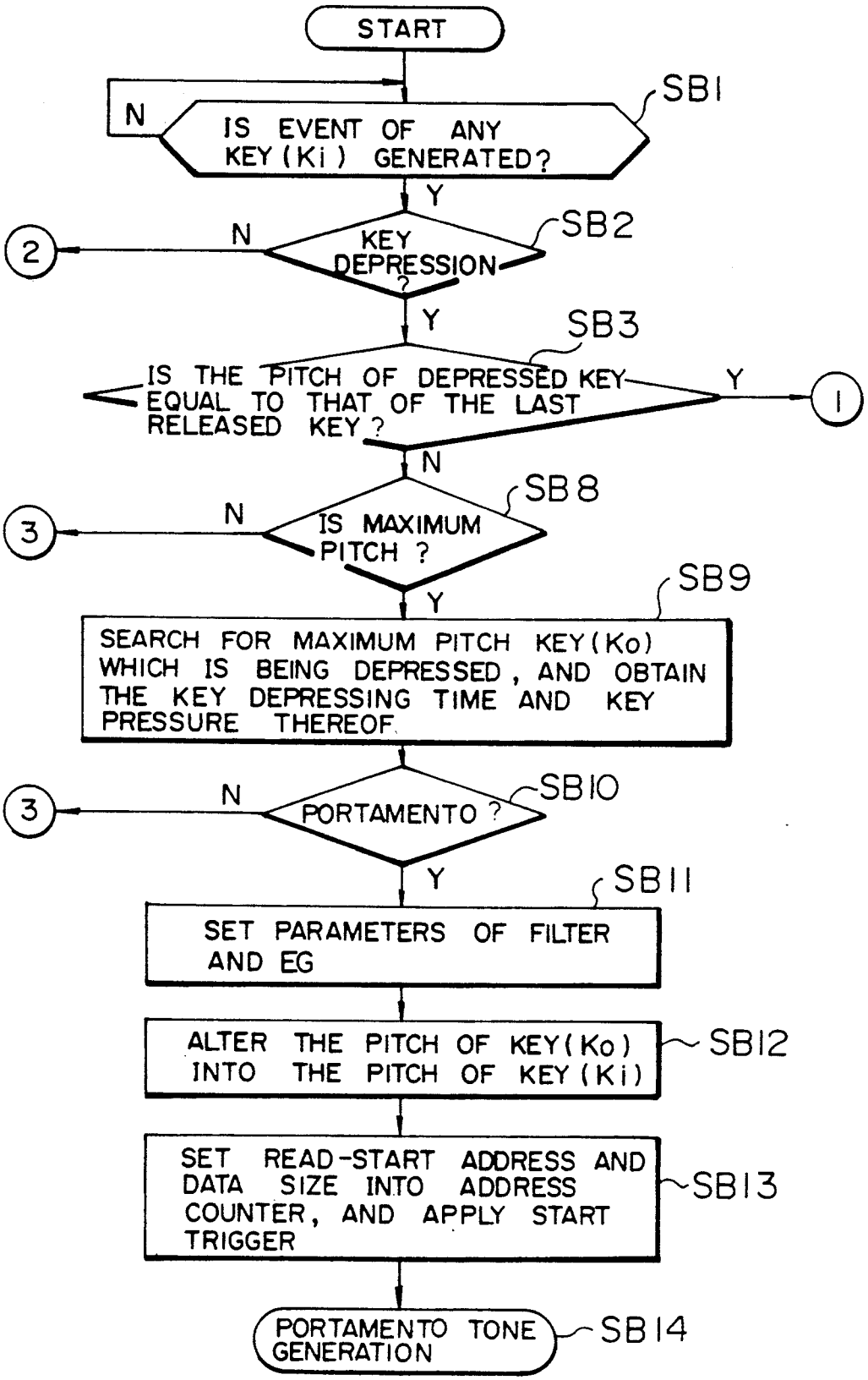
FIGS. 14 through 17 are flow charts showing the operation of the CPU 1 depicted in FIG. 13.
Figure 15:
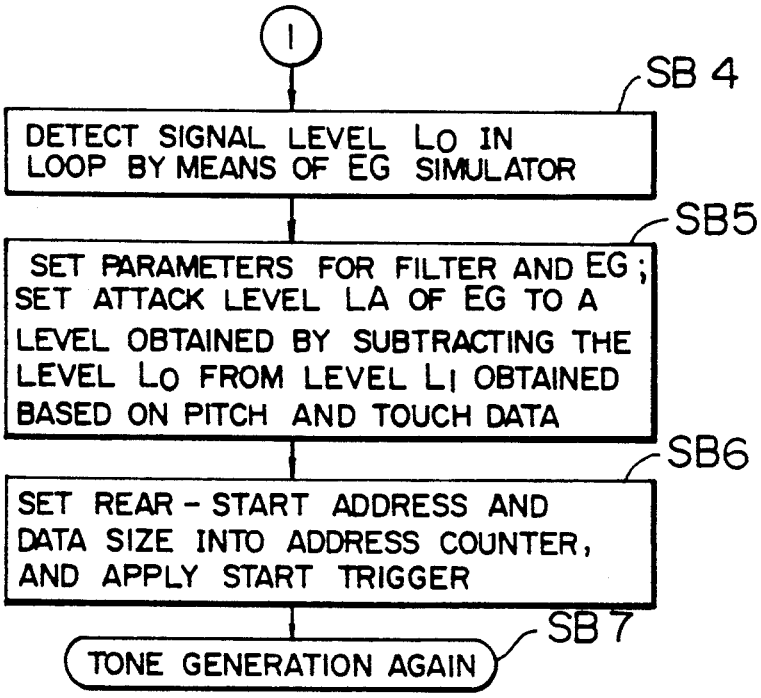
Figure 16:
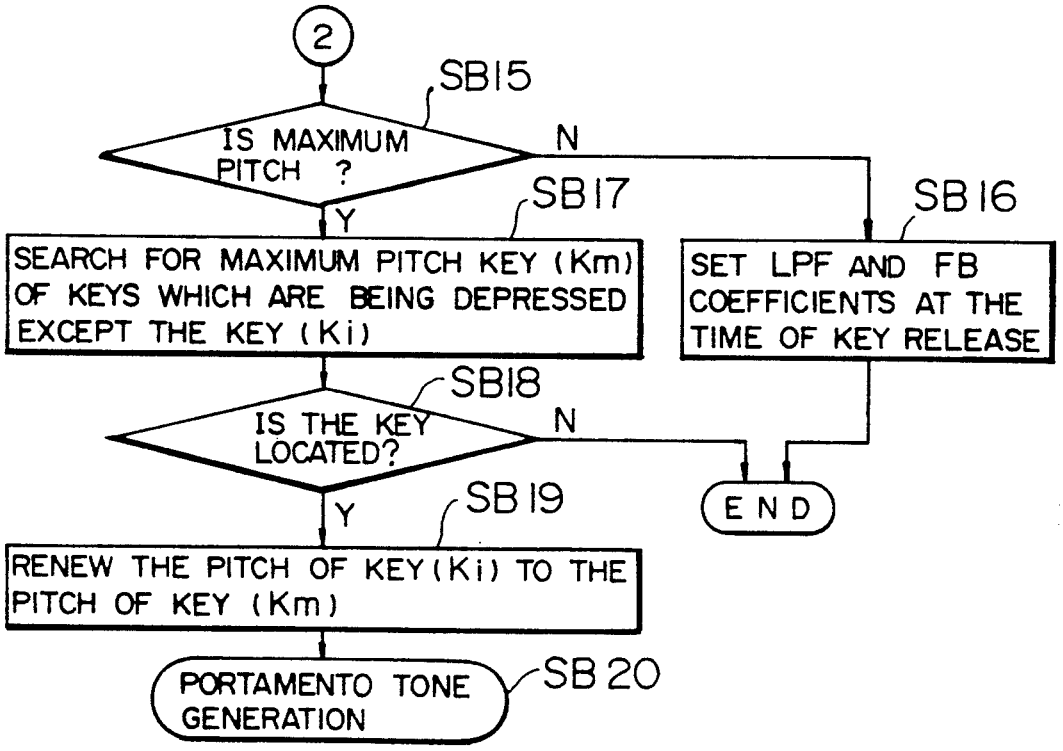

First, the situation of the routine goes to a step SB1 in FIG. 14. In the step SB1, the CPU 1 makes a judgment as to whether there is any event of a key (Ki). While the judgment results in "NO", the same judgment is repeated. When the performer manipulates a key (Ki) in the keyboard 54, the judgment in the step SB1 results in "YES" and the situation of the routine goes to a step SB2.

In the step SB2, a judgment is made as to whether a key (Ki) is depressed. When the judgment results in "YES", the situation of the routine goes to a step SB3.

In the step SB3, a judgment is made as to whether the pitch of the depressed key (Ki) is equal to the pitch of the last released key. When the judgment results in "YES", the situation of the routine goes to a step SB4 in FIG. 15.

In the step SB4, the channel (physical model tone generator 72) of the pitch of the last released key is searched for and then the level L0 of the signal currently circulating in the closed loop of the physical model tone generator 72 is detected by controlling the EG simulator 76. Then, the situation of the routine goes to a step SB5.

In the step SB5, parameters for the filter 73 and the EG 74 in the physical model tone generator 72 of the pitch of the last released key are set. At this time, the attack level LA of the envelope signal outputted from the EG 74 is set to the level obtained by subtracting the level L0 detected in the step SB4 from the level L1 of the driving waveform data determined on the basis of pitch and touch data outputted from the keyboard 54 and the control manipulator 55. Then, the situation of the routine goes to a step SB6.

In the step SB6, a reading start address and the size of data are set in the address counter 8 in the corresponding physical model tone generator 72 and then a start trigger is applied. Then, the situation of the routine goes to a step SB7.

In the step SB7, a tone is generated again on the basis of the variable sampling frequency Fa synchronized with the pitch. That is, the address counter 8 generates read addresses, so that driving waveform data are successively read from the driving waveform ROM correspondingly to the read addresses.

Hereby, the driving waveform data read from the driving waveform ROM 7 in the corresponding physical model tone generator 72 is multiplied by the envelope signal outputted from the EG 74 in the multiplier 75 via the filter 73 and then fed to one input terminal of the adder 9. On the other hand, the signal of the same pitch repeatedly circulates while decaying in the closed loop constituted by the route: the adder 9→the shift register 10→the multiplier 11→the LPF 12. Accordingly, the level-controlled signal through the filter 73 and the multiplier 75 is newly superimposed onto the circulating signal. The resulting signal gradually decays while circulating in the closed loop.

Then, in the sampling converter/mixing circuit 77, the variable sampling frequency Fa is converted into a fixed sampling frequency Fs of the system and, at the same time, the tone signal outputted from the output terminal of the adder 9 is mixed with the tone signals outputted from the other physical model tone generator 72 and subjected to sampling conversion. Then, the mixed signal is outputted from the output terminal 78.

As a result, the performance style of repeatedly plucking a string of the guitar can be simulated perfectly.

When, on the contrary, the judgment in the step SB3 in FIG. 14 results in "NO", that is, when the pitch of the newly depressed key (Ki) is not equal to the pitch of the last released key, the situation of the routine goes to a step SB8.

In the step SB8, a judgment is made as to whether the newly depressed key (Ki) has a higher pitch than the highest pitch key (hereinafter also called "maximum pitch key") (Ko) of already depressed keys. When the judgment results in "YES", the situation of the routine goes to a step SB9.

In the step SB9, the maximum pitch key (Ko) is searched for, so that the key depressing time and the key pressure thereof, that is, the values of after touch (each key after), are detected. Then, the situation of the routine goes to a step SB10.

In the step SB10, a judgment is made as to whether the effect of portamento is provided. This judgment is based on a judgment as to whether the key depressing time detected in the step SB9 has passed a predetermined limit period and the after touch exceeds a set value. When the judgment results in "YES", the situation of the routine goes to a step SB11.

In the step SB11, parameters for the filter 73 and the EG 74 in the channel (physical model tone generator 72) assigned for the pitch of the maximum pitch key (Ko) are set to values different from those in the normal tone generating process, on the basis of the information of touch and pitch corresponding to the key (Ki). Then, the situation of the routine goes to a step SB12.

In the step SB12, the pitch of the maximum pitch key (Ko) is altered to the pitch of the key (Ki). That is, parameters for constituent elements of the closed loop in the physical model tone generator 72 assigned for the pitch of the maximum pitch key (Ko) are set again correspondingly to the pitch of the key (Ki). Then, the situation of the routine goes to a step SB13.

In the step SB13, the read address and the size are set in the address counter 8 and then a start trigger is applied. Then, the situation of the routine goes to a step SB14.

In the step SB14, the variable sampling frequency Fa is changed at a predetermined speed Sp so that the pitch can change from the pitch of the maximum pitch key (Ko) to the pitch of the key (Ki). As a result, the portamento tone generating process is carried out.

By the aforementioned routine, the hammering-on style of the guitar can be simulated.

When, on the contrary, the judgment in the step SB2 results in "NO", that is, when a key (Ki) is not depressed but released, the situation of the routine goes to a step SB15.

In the step SB15, a judgment is made as to whether the newly released key (Ki) is equal to the maximum pitch key (Ko). When the judgment results in "NO", the situation of the routine goes to a step SB16.

In the step SB16, the coefficient of the LPF 12 and the feedback coefficient FB of the multiplier 11 in the channel (physical model tone generator 72) assigned for the pitch of the key (Ki) are set and then a series of procedures is terminated.

When, on the contrary, the judgment in the step SB15 results in "YES", that is, when the newly released key (Ki) is equal to the maximum pitch key (Ko), the situation of the routine goes to a step SB17.

In the step SB17, the maximum pitch key (Km) is searched for among currently depressed keys except the key (Ki). Then, the situation of the routine goes to a step SB18.

In the step SB18, a judgment is made as to whether the maximum pitch key (Km) exists. When the judgment results in "NO", a series of procedures is terminated.

When, on the contrary, the judgment in the step SB18 results in "YES", that is, when the maximum pitch key (Ko) exists, the situation of the routine goes to a step SB19.

In the step SB19, the pitch of the key (Ki) is altered to the pitch of the maximum pitch key (Km). That is, parameters for constituent elements of the closed loop in the physical model tone generator 72 assigned for the pitch of the key (Ki) are set again correspondingly to the pitch of the maximum pitch key (Km). Then, the situation of the routine goes to a step SB20.

In the step SB20, the variable sampling frequency Fa is changed at a predetermined speed Sp so that the pitch can change from the pitch of the key (Ki) to the pitch of the maximum pitch key (Km). As a result, the portamento tone generating process is carried out.

By the aforementioned routine, the pulling-off style of the guitar can be simulated.

Figure 17:
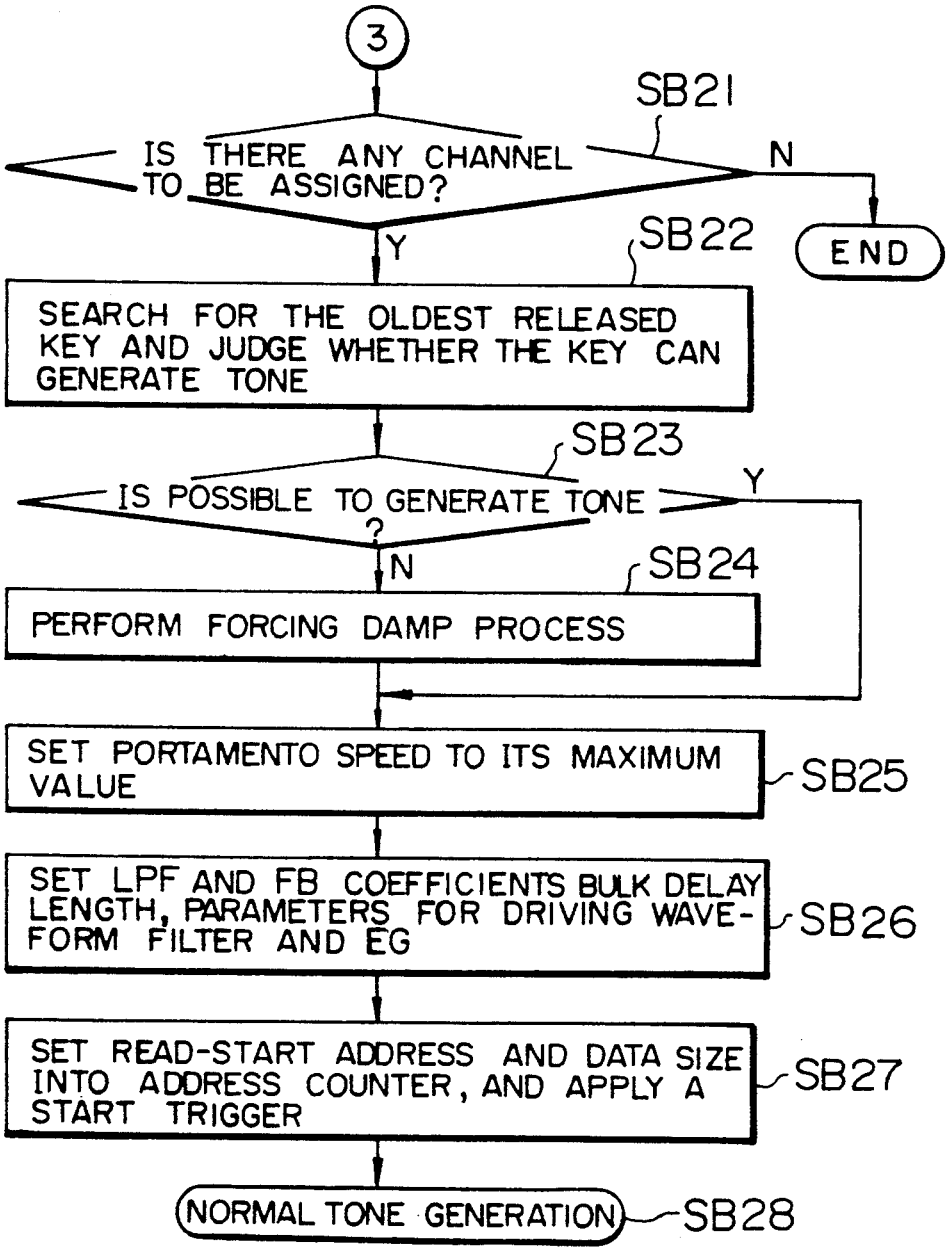

When, on the contrary, the judgment in the step SB8 in FIG. 14 results in "NO", that is, when the pitch of the newly depressed key (Ki) is not higher than the pitch of the maximum pitch key (Ko), the situation of the routine goes to a step SB21 in FIG. 17. When the judgment in the step SB10 in FIG. 14 results in "NO", that is, when the effect of portamento is not provided, the situation of the routine also goes to the step SB21 in FIG. 17.

In the step SB21, a judgment is made as to whether there is any channel allowed to be assigned for the key (Ki). When the judgment results in "NO", a series of procedures is terminated.

When, on the contrary, the judgment in the step SB21 results in "YES", that is, when there is any channel allowed to be assigned, the situation of the routine goes to a step SB22.

In the step SB22, the oldest released key is searched for to make a judgment as to whether the channel assigned for the oldest released key is enabled to generate a tone. Then, the situation of the routine goes to a step SB23.

In the step SB23, a judgment is made as to whether the channel assigned for the oldest released key is enabled to generate a tone. When the judgment results in "NO", the situation of the routine goes to a step SB24.

In the step SB24, a forcing damp process is carried out. Then, the situation of the routine goes to a step SB25.

When, on the contrary, the judgment in the step SB23 results in "YES", that is, when the channel assigned for the oldest released key is enabled to generate a tone, the situation of the routine also goes to the step SB25.

In the step SB25, the portamento speed is set to its maximum. Then, the situation of the routine goes to a step SB26.

In the step SB26, the coefficient of the LPF 12, the feedback coefficient FB of the multiplier 11, the delay length of the shift register 10 and the respective parameters of the filter 73 and the EG 74 in the corresponding channel (physical model tone generator) are set correspondingly to the pitch of the key (Ki). Then, the situation of the routine goes to a step SB27.

In the step SB27, the read address and the size are set in the address counter 28 and then a start trigger is applied. Then, the situation of the routine goes to a step SB28.

In the step SB28, a normal tone generating process is carried out.

According to the aforementioned fifth embodiment, not only the performance style of repeatedly plucking a string in a plucked string instrument such as a guitar can be simulated without deformation of the resulting tone signal but the effect of portamento (slur) can be provided.

Although the aforementioned fifth embodiment has shown the case where the judgment as to whether the portamento is provided is based on the judgment as to whether the key depressing time of the maximum pitch key (Ko) detected in the step SB9 has passed a predetermined limit period and the after touch exceeds a set value, the invention is not limited thereto. For example, the judgment may be modified so that the effect of portamento can be provided when a key (Ki)is depressed newly in the condition in which the key depressing time of the maximum pitch key (Ko) has not yet passed a predetermined period. This modification may be more natural particularly for simulation of the hammering-on style.

Although the aforementioned fifth embodiment has shown the case where the judgment as to whether the effect of portamento is provided is made automatically by the CPU 1, the invention can be applied to the case where the judgment as to whether the effect of portamento is provided may be made by the performer's manipulation of a foot switch or the like as the control manipulator 55 or correspondingly to tone color or the like.

Although the aforementioned fifth embodiment has shown the case where the level of the signal circulating in the closed loop in each of the physical model tone generators 72 is detected by using the EG simulator 76, the invention can be applied to the case where the case where the level of the signal circulating in the closed loop in each physical model tone generator 72 may be detected by using a peak detector. Alternately, the level of the signal circulating in the closed loop in each physical model tone generator 72 may be detected by the CPU 1 including a dedicated circuit or timer through detecting the decay quantity of the signal on the basis of the key depressing time and the feedback coefficient FB of the multiplier 11.

Although the preferred forms of the present invention have been described, it is to be understood that modifications will be apparent to those skilled in the art without departing from the spirit of the invention. The scope of the invention, therefore, is to be determined solely by the following claims.

What is claimed is:

1. An electronic musical instrument for generating musical tones in response to input performance information, comprising:

driving signal generator means for generating a plurality of driving signals corresponding to performance information; and loop means having a loop for repeatedly circulating said plurality of driving signals, said loop comprising:

delay means for independently delaying said plurality of circulating driving signals in time sharing fashion, depending on the pitch of a musical tone to be generated corresponding to said performance information;

filter means for independently filtering said plurality of circulating driving signals in time sharing fashion, said filter means having filter characteristics controlled by variable filter coefficients whose values correspond to said performance information, said filter means delaying the driving signals by a variable amount corresponding to the variation of filter characteristics; and control means for controlling the amount of delay of the delay means based upon the pitch of a tone to be generated and the amount of delay of the filter means;

whereby a plurality of signals circulating in the loop as a plurality of tone signals are generated.

2. An electronic musical instrument comprising:

driving signal generator means for generating a driving signal corresponding to performance information;

loop means having a loop for repeatedly circulating said driving signal, said loop comprising:

delay means for delaying said circulating driving signal, depending on the pitch of a musical tone to be generated, corresponding to said performance information;

filter means for filtering said plurality of circulating driving signals, said filter means having filter characteristics controlled by variable filter coefficients whose values correspond to said performance information, said filter means delaying the driving signals by a variable amount corresponding to the variation of filter characteristics;

whereby a signal circulating in the loop as a tone signal is generated;

memory means for storing parameters used by said delay means and in said filter means corresponding to said performance information, by which said delay means and said filter means delays and filters said circulating driving signal, respectively, by using said parameters stored in said memory means corresponding to said performance information; and control means for controlling the amount of delay of the delay means based upon the pitch of a tone to be generated and the amount of delay of the filter means.

3. An electronic musical instrument comprising:

driving signal generator means for generating a driving signal corresponding to performance information;

loop means having a loop for repeatedly circulating said driving signal, said loop comprising:

delay means for delaying said circulating driving signal, depending on the pitch of a musical tone to be generated, corresponding to said performance information;

filter means for filtering said circulating driving signal said filter means having filter characteristics controlled by variable filter coefficients whose values correspond to said performance information said filter means delaying the driving signals by a variable amount corresponding to the variation of filter characteristics;

whereby a signal circulating in the loop as a tone signal is generated;

a coefficient interpolation circuit for interpolating values of respective coefficients used in said delay means and in said filter means to target values corresponding to said performance information at a predetermined speed; and control means for controlling the amount of delay of the delay means based upon the pitch of a tone to be generated and the amount of delay of the filter means.

4. An electronic musical instrument comprising:

driving signal generator means for generating a driving signal corresponding to performance information;

loop means having a loop for repeatedly circulating said driving signal, the loop having a plurality of output points, said loop comprising:

delay means for delaying said circulating driving signal, depending on the pitch of a musical tone to be generated, corresponding to said performance information;

filter means for filtering said circulating driving signal, said filter means having filter characteristics controlled by variable filter coefficients whose values correspond to said performance information, said filter means delaying the driving signals by a variable amount corresponding to the variation of filter characteristics;

whereby a signal circulating in the loop as a tone signal is generated;

mixer means for mixing signals outputted form the plurality of output points of the loop and for generating an output signal thereform as a tone signal; and control means for controlling the amount of delay of the delay means based upon the pitch of a tone to be generated and the amount of delay of the filter means.

5. An electronic musical instrument according to claim 4 wherein one output point is at a point within the delay means, further comprising a modulator means for modulating the read out point from the delay means with a signal of a predetermined frequency and for supplying said modulated signal to said mixer means.

6. An electronic musical instrument comprising:

driving signal generator means for generating a plurality of driving signals corresponding to performance information;

a plurality of loop means, each having a loop for repeatedly circulating said plurality of driving signals, each said loop comprising:

delay means for variably delaying said driving signal depending on an octave number of musical tone to be generated, corresponding to said performance information;

filter means for filtering said driving signal, said filter means having filter characteristics controlled by variable filter coefficients whose values corresponding to said performance information, said filter means delaying the driving signals by a variable amount corresponding to the variation of filter characteristics;

an output point for taking out an output signal;

whereby a signal circulating in the loop as a tone signal is generated;

control means for controlling the amount of delay of the delay means based upon the pitch of a tone to be generated and the amount of delay of the filter means; and each of said loop means further comprising a sampling frequency converter circuit connected to said output point and having a variable sampling time corresponding to tone pitch variation in an octave.

7. An electronic musical instrument according to claim 6, wherein said loop means has correction means for correcting values of respective coefficients used in at least one of said delay means and said decay means, to thereby enable musical tones be equalized at the boundary of said octaves.

8. An electronic musical instrument comprising:

memory means for storing pulse code modulated waveform data;

tone generator means for generating a tone signal through reading said waveform data from said memory means corresponding to performance information;

an envelope generator for generating an envelope signal for controlling the amplitude of said tone signal to thereby control the sound volume and tone color of said tone signal;

multiplier means for multiplying said waveform signal read from said memory means by said envelope signal;

loop means having a loop for circulating an output signal from said multiplier means, said loop comprising:

delay means for delaying said output signal, depending on the pitch of a musical tone to be generated, corresponding to said performance information; and filter means for filtering said output signal corresponding to said performance information, said filter means having filter characteristics controlled by variable filter coefficients whose values correspond to said performance information, said filter means delaying the driving signals by a variable amount corresponding to the variation of filter characteristics;

whereby a signal circulating in the loop as a tone signal is generated;

control means for controlling the amount of delay of the delay means based upon the pitch of a tone to be generated and the amount of delay of the filter means; and mixer means for mixing an output signal from said tone generator means with said output signal from said loop means.

9. An electronic musical instrument comprising:

driving signal generator means for generating a plurality of driving signals corresponding to plural pieces of performance information; and a plurality of loop means, each having a loop, for repeatedly circulating said plurality of driving signals, each said loop comprising:

delay means for delaying said driving signal, depending on frequency of musical tone to generated, corresponding to said performance information; and decay means for decaying said driving signal corresponding to said performance information;

whereby a signal circulating in the loop as a tone signal is generated when said plural pieces of performance information are assigned to said plurality of loop means;

control means for achieving such control that when one and the same performance data is newly supplied in the condition where a decayed signal remains in an already assigned loop means, said performance data is assigned to said loop means and at the same time the level of said signal circulating in the loop is detected and subtracting from the level of a driving signal outputted from said driving signal generator means corresponding to said performance information to supply the resulting level to said loop means.

10. An electronic musical instrument comprising:

driving signal generator means for generating a plurality of driving signals corresponding to plural pieces of performance information; and a plurality of loop means, each having a loop, for repeatedly circulating said plurality of driving signals, each said loop comprising:

delay means for delaying said driving signal, depending on frequency of musical tone to generated, corresponding to said performance information; and decay means for decaying said driving signal corresponding to said performance information;

whereby a signal circulating in the loop as a tone signal is generated when said plurality of performance data are assigned to said plurality of loop means, wherein when a piece of performance information of a higher pitch than the highest pitch among signals in already assigned loop means is supplied and a predetermined condition is satisfied, the pitch of a signal in loop means is gradually changed in a predetermined range of variation.

* * * * *